US006702420B2

(12) United States Patent
Tanaka

(10) Patent No.: US 6,702,420 B2
(45) Date of Patent: Mar. 9, 2004

(54) LIQUID JETTING APPARATUS

(75) Inventor: Ryoichi Tanaka, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/286,944

(22) Filed: Nov. 4, 2002

(65) Prior Publication Data

US 2003/0085936 A1 May 8, 2003

(30) Foreign Application Priority Data

Nov. 5, 2001 (JP) ..... 2001-339385
Dec. 28, 2001 (JP) ..... 2001-400370

(51) Int. Cl.[7] ..... B41J 29/393
(52) U.S. Cl. ..... 347/19
(58) Field of Search ..... 347/19, 12, 10, 347/11, 14, 16, 15, 9, 40, 41, 37; 358/298; 395/105; 400/279

(56) References Cited

U.S. PATENT DOCUMENTS 5,997,123 A * 12/1999 Takekoshi et al. ..... 347/14
6,312,084 B1 * 11/2001 Ujita et al. ..... 347/19

FOREIGN PATENT DOCUMENTS

JP 2000-1001 1/2000

* cited by examiner

*Primary Examiner*—Stephen D. Meier
*Assistant Examiner*—Charles Stewart, Jr.
(74) *Attorney, Agent, or Firm*—Sughrue Mion, PLLC

(57) ABSTRACT

A plurality of forward pulse-waiting-times are respectively defined correspondingly to respective forward-timings that are defined correspondingly to a plurality of predetermined passage-positions while the head member is moved forward. A plurality of backward pulse-waiting-times are respectively defined correspondingly to respective backward-timings that are defined correspondingly to the plurality of predetermined passage-positions while the head member is moved backward. A forward jetting-driving signal includes a plurality of forward pulse-waves that respectively rise up or fall down when the respective forward pulse-waiting-times have passed since the respective forward-timings. A backward jetting-driving signal includes a plurality of backward pulse-waves that respectively rise up or fall down when the respective backward pulse-waiting-times have passed since the respective backward-timings. Each forward pulse-wave and each backward pulse-wave have the same waveform.

48 Claims, 15 Drawing Sheets

LIQUID JETTING APPARATUS

FIELD OF THE INVENTION

This invention relates to a liquid jetting apparatus having a head member capable of jetting a drop of liquid from a nozzle. In particular, this invention relates to a liquid jetting apparatus having a head member of jetting a plurality of drops of liquid from a nozzle while the head member is moved both forward and backward.

BACKGROUND OF THE INVENTION

In a ink-jetting recording apparatus such as an ink-jetting printer or an ink-jetting plotter (a kind of liquid jetting apparatus), a recording head (head member) can move in a main scanning direction, and a recording paper (a kind of medium onto which liquid is to be jetted) can move in a sub-scanning direction perpendicular to the main scanning direction. While the recording head moves in the main scanning direction, a drop of ink can be jetted from a nozzle of the recording head onto the recording paper. Thus, an image including a character or the like can be recorded on the recording paper. For example, the drop of ink can be jetted by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is jetted from the nozzle.

In such a recording apparatus, a driving signal consisting of a series of a plurality of driving-pulses is generated. On the other hand, printing data that define whether a drop of ink is jetted or not can be transmitted to the recording head. Then, based on the transmitted printing data, only necessary one or more driving-pulses are selected from the driving signal and supplied to the piezoelectric vibrating member. That is, whether a drop of ink is jetted from a nozzle is determined based on the printing data.

In order to conduct the recording operation to the recording paper faster, it is preferable that drops of ink are jetted from the nozzle of the recording head both while the recording head is moved forward in the main scanning direction and while the recording head is moved backward in the main scanning direction, to record an image including a character or the like on the recording paper. That is, preferably, after a recording operation for one line has been conducted during a forward movement of the recording head, the recording head is moved relatively to the recording paper in the sub-scanning direction by a width of line (including a gap between lines), and then a recording operation for the next line is conducted during a backward movement of the recording head. Such an ink-jetting recording apparatus, which can record while the recording head is moved both forward and backward, is called a double-direction type (Bi-D) of apparatus.

For such a double-direction type of ink-jetting recording apparatus, in order to enhance recording accuracy, it is preferable that a waveform of a driving signal for the forward movement of the recording head and a waveform of a driving signal for the backward movement of the recording head are separately generated. Generation of the waveforms of the driving signals is disclosed in detail in Japanese Patent Laid-Open Publication No. 2000-1001.

Herein, as shown in FIGS. 21A to 21D, in the conventional driving signals for the forward movement of the recording head and for the backward movement of the recording head, a waiting time S from a timing signal for each image unit until a fall (or a rise) of each pulse-wave PW is fixed.

In the case, if the recording head is moved at a constant speed, there is no gap between a point (position) which a drop of ink jetted during a forward movement of the recording head reaches and a point which a drop of ink jetted during a backward movement of the recording head reaches. That is, no reaching-position gap (Bi-d gap) is generated.

In detail, as shown in FIG. 21A, if the speed of the recording head is constant at $V_0$, the recording head passes through a plurality of predetermined passage-positions $P_0$, $P_1$, $P_2$, . . . at respective times $t_0$, $t_1$, $t_2$, . . . Herein, time gaps of $t_1-t_0=\Delta t_0$, $t_2-t_1=\Delta t_1$, . . . are always constant (see FIGS. 21B and 21C). Thus, the constant waiting time S is a necessary condition to prevent generation of the reaching-position gap (see FIGS. 21C and 21D).

However, if the recording head is moved at a variable speed, as shown in FIGS. 22A to 22D, a reaching-position gap may be generated between a point which a drop of ink jetted during a forward movement of the recording head reaches and a point which a drop of ink jetted during a backward movement of the recording head reaches.

In detail, as shown in FIG. 22A, if the speed of the recording head is increased toward $V_0$, the recording head passes through a plurality of predetermined passage-positions $P_0$, $P_1$, $P_2$, . . . at respective times $t_0$, $t_1$, $t_2$, . . . Herein, time gaps of $t_1-t_0=\Delta t_0$, $t_2-t_1=\Delta t_1$, . . . become shorter and then become constant (see FIGS. 22B and 22C). Thus, the constant waiting time S may generate a Bi-D gap, that is, jetted drops of ink may not be aligned in the sub-scanning direction (see FIGS. 22C and 22D).

SUMMARY OF THE INVENTION

The object of this invention is to solve the above problems, that is, to provide a liquid jetting apparatus such as an ink-jet recording apparatus that can suitably adjust positions which drops of liquid jetted from a nozzle reach, even when a forward and backward moving speed of the nozzle is changed.

In order to achieve the object, a liquid jetting apparatus includes: a head member having a nozzle; a pressure-changing unit for causing pressure of liquid in the nozzle to change in such a manner that the liquid is jetted from the nozzle; a reciprocating mechanism that can move the head member forward and backward at a variable speed in such a manner that the head member passes through a plurality of predetermined passage-positions; a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head member is moved forward, and that can cause the pressure-changing unit to operate based on the backward driving pulse while the head member is moved backward; wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

According to the feature, as the plurality of forward pulse-waiting-times are respectively defined correspondingly to the respective forward-timings and the plurality of backward pulse-waiting-times are respectively defined correspondingly to the respective backward-timings, even if a moving speed of the head member is not constant, generation of a Bi-D gap can be prevented.

Preferably, the plurality of forward pulse-waiting-times are respectively defined correspondingly to the respective forward-timings, dependently on a forward-moving state of the head member by means of the reciprocating mechanism, and the plurality of backward pulse-waiting-times are respectively defined correspondingly to the respective backward-timings, dependently on a backward-moving state of the head member by means of the reciprocating mechanism.

In the case, the forward jetting-driving signal is generated correspondingly to the forward-moving state of the head member and the backward jetting-driving signal is generated correspondingly to the backward-moving state of the head member. Thus, even if the forward-moving state of the head member and/or the backward-moving state of the head member include an acceleration and/or deceleration state, generation of a Bi-D gap can be prevented.

In addition, preferably, the plurality of forward pulse-waiting-times are respectively defined correspondingly to the respective forward-timings, based on a predetermined acceleration-deceleration curve for the head member to be moved forward, and the plurality of backward pulse-waiting-times are respectively defined correspondingly to the respective backward-timings, based on a predetermined acceleration-deceleration curve for the head member to be moved backward.

Alternatively, preferably, the plurality of forward pulse-waiting-times are respectively defined correspondingly to the respective forward-timings, based on respective speeds of the head member obtained at the respective forward-timings, and the plurality of backward pulse-waiting-times are respectively defined correspondingly to the respective backward-timings, based on respective speeds of the head member obtained at the respective backward-timings.

Alternatively, preferably, the plurality of forward pulse-waiting-times are respectively defined correspondingly to the respective forward-timings, based on changes of respective time-gaps between adjacent two forward-timings, and the plurality of backward pulse-waiting-times are respectively defined correspondingly to the respective backward-timings, based on changes of respective time-gaps between adjacent two backward-timings.

In addition, preferably, the plurality of forward pulse-waiting-times are respectively defined correspondingly to the respective forward-timings, based on information of environment in which the liquid jetting apparatus is installed, for example temperature information and/or humidity information, and the plurality of backward pulse-waiting-times are respectively defined correspondingly to the respective backward-timings, based on the information of environment.

In addition, preferably, the plurality of forward pulse-waiting-times are respectively defined correspondingly to the respective forward-timings, based on information of an amount of liquid remaining in the head member, and the plurality of backward pulse-waiting-times are respectively defined correspondingly to the respective backward-timings, based on the information of an amount of liquid.

In addition, preferably, the plurality of forward pulse-waiting-times are respectively defined correspondingly to the respective forward-timings in such a manner that a plurality of drops of liquid can be jetted at respective intermediate timings between adjacent two forward-timings, and the plurality of backward pulse-waiting-times are respectively defined correspondingly to the respective backward-timings in such a manner that a plurality of drops of liquid can be jetted at respective intermediate timings between adjacent two backward-timings.

Alternatively, preferably, the plurality of forward pulse-waiting-times are respectively defined correspondingly to the respective forward-timings in such a manner that a plurality of drops of liquid can be jetted at respective intermediate positions between adjacent two passage-positions of the head member, the respective passage-positions corresponding to the respective forward-timings, and the plurality of backward pulse-waiting-times are respectively defined correspondingly to the respective backward-timings in such a manner that a plurality of drops of liquid can be jetted at respective intermediate positions between adjacent two passage-positions of the head member, the respective passage-positions corresponding to the respective backward-timings.

In addition, preferably, the liquid jetting apparatus further includes a supporting member that can support a medium, onto which liquid is to be jetted, in such a manner that the medium can face the nozzle of the head member moved forward and backward and that the medium is spaced away from the nozzle by substantially the same gap, and a position on the medium which a drop of liquid jetted by means of a forward pulse-wave reaches substantially coincides with a position on the medium which a drop of liquid jetted by means of a backward pulse-wave reaches, with respect to a direction in which the head member is moved forward and backward.

In addition, another liquid jetting apparatus of the invention includes: a head member having a nozzle; a pressure-changing unit that can cause pressure of liquid in the nozzle to change in such a manner that the liquid is jetted from the nozzle; a reciprocating mechanism that can move the head member forward and backward at a variable speed in such a manner that the head member passes through a plurality of predetermined passage-positions; a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head meter is moved forward, and that can cause the pressure-changing unit to operate based on the backward driving pulse while the head member is moved backward; wherein: a plurality of first forward pulse-waiting-times are respectively defined correspondingly to the respective forward-timings; a plurality of second forward pulse-waiting-times are also respectively defined correspondingly to the respective forward-timings; a plurality of first backward pulse-waiting-times are respectively defined correspondingly to the respective backward-timings; a plurality of second backward pulse-waiting-times are also respectively defined correspondingly to the respective backward-timings; the forward jetting-driving signal includes a plurality of forward first pulse-waves that respectively rise up or fall down when the respective first forward pulse-waiting-times have passed since the respective forward-timings, and a plurality of forward second pulse-waves that respectively rise up or fall down when the respective second forward pulse-waiting-times have passed since the respective forward-timings; the backward jetting-driving signal includes a plurality of backward first pulse-waves that respectively rise up or fall down when the respective first backward pulse-waiting-times have passed since the respective backward-timings, and a plurality of backward second pulse-waves that respectively rise up or fall down when the respective second backward pulse-waiting-times have passed since the respective backward-timings; each forward first pulse-wave and each backward second pulse-wave have the same waveform; and each forward second pulse-wave and each backward first pulse-wave have the same waveform.

According to the feature, as the plurality of first forward pulse-waiting-times and the plurality of second forward pulse-waiting-times are respectively defined correspondingly to the respective forward-timings and the plurality of first backward pulse-waiting-times and the plurality of second backward pulse-waiting-times are respectively defined correspondingly to the respective backward-timings, even if a moving speed of the head member is not constant, positions at which two drops of liquid are jetted in each image unit can be adjusted to be always constant.

Preferably, the plurality of first forward pulse-waiting-times are respectively defined correspondingly to the respective forward-timings, dependently on a forward-moving state of the head member by means of the reciprocating mechanism; the plurality of second forward pulse-waiting-times are also respectively defined correspondingly to the respective forward-timings, dependently on the forward-moving state of the head member by means of the reciprocating mechanism; the plurality of first backward pulse-waiting-times are respectively defined correspondingly to the respective backward-timings, dependently on a backward-moving state of the head member by means of the reciprocating mechanism; and the plurality of second backward pulse-waiting-times are also respectively defined correspondingly to the respective backward-timings, dependently on the backward-moving state of the head member by means of the reciprocating mechanism.

In the case, the forward jetting-driving signal is generated correspondingly to the forward-moving state of the head member and the backward jetting-driving signal is generated correspondingly to the backward-moving state of the head member. Thus, even if the forward-moving state of the head member and/or the backward-moving state of the head member include an acceleration and/or deceleration state, generation of a Bi-D gap or the like can be prevented.

In addition, preferably, the plurality of first forward pulse-waiting-times are respectively defined correspondingly to the respective forward-timings, based on a predetermined acceleration-deceleration curve for the head member to be moved forward; the plurality of second forward pulse-waiting-times are also respectively defined correspondingly to the respective forward-timings, based on the predetermined acceleration-deceleration curve for the head member to be moved forward; the plurality of first backward pulse-waiting-times are respectively defined correspondingly to the respective backward-timings, based on a predetermined acceleration-deceleration curve for the head member to be moved backward; and the plurality of second backward pulse-waiting-times are also respectively defined correspondingly to the respective backward-timings, based on the predetermined acceleration-deceleration curve for the head member to be moved backward.

Alternatively, preferably, the plurality of first forward pulse-waiting-times are respectively defined correspondingly to the respective forward-timings, based on respective speeds of the head member obtained at the respective forward-timings; the plurality of second forward pulse-waiting-times are also respectively defined correspondingly to the respective forward-timings, based on the respective speeds of the head member obtained at the respective forward-timings; the plurality of first backward pulse-waiting-times are respectively defined correspondingly to the respective backward-timings, based on respective speeds of the head member obtained at the respective backward-timings; and the plurality of second backward pulse-waiting-times are also respectively defined correspondingly to the respective backward-timings, based on the respective speeds of the head member obtained at the respective backward-timings.

Alternatively, preferably, the plurality of first forward pulse-waiting-times are respectively defined correspondingly to the respective forward-timings, based on changes of respective time-gaps between adjacent two forward-timings; the plurality of second forward pulse-waiting-times are also respectively defined correspondingly to the respective forward-timings, based on the changes of respective time-gaps between adjacent two forward-timings; the plurality of first backward pulse-waiting-times are respectively defined correspondingly to the respective backward-timings, based on changes of respective time-gaps between adjacent two backward-timings; and the plurality of second backward pulse-waiting-times are also respectively defined correspondingly to the respective backward-timings, based on the changes of respective time-gaps between adjacent two backward-timings.

In addition, preferably, the plurality of first forward pulse-waiting-times are respectively defined correspondingly to the respective forward-timings, based on information of environment in which the liquid jetting apparatus is installed, for example temperature information and/or humidity information; the plurality of second forward pulse-waiting-times are also respectively defined correspondingly to the respective forward-timings, based on the information of environment; the plurality of first backward pulse-waiting-times are respectively defined correspondingly to the respective backward-timings, based on the information of environment; and the plurality of second backward pulse-waiting-times are also respectively defined correspondingly to the respective backward-timings, based on the information of environment.

In addition, preferably, the plurality of first forward pulse-waiting-times are respectively defined correspondingly to the respective forward-timings, based on information of an amount of liquid remaining in the head member; the plurality of second forward pulse-waiting-times are also respectively defined correspondingly to the respective forward-timings, based on the information of an amount of liquid; the plurality of first backward pulse-waiting-times are respectively defined correspondingly to the respective backward-timings, based on the information of an amount of liquid; and the plurality of second backward pulse-waiting-times are also respectively defined correspondingly to the respective backward-timings, based on the information of an amount of liquid.

In addition, preferably, the plurality of first forward pulse-waiting-times and the plurality of second forward pulse-waiting-times are respectively defined correspondingly to the respective forward-timings in such a manner that each difference between each first forward pulse-waiting-times and each second forward pulse-waiting-times corresponding to each forward-timing is a half of time-gap between the forward-timing and the next forward-timing; and the plurality of first backward pulse-waiting-times and the plurality of second backward pulse-waiting-times are respectively defined correspondingly to the respective backward-timings in such a manner that each difference between each first backward pulse-waiting-times and each second backward pulse-waiting-times corresponding to each backward-timing is a half of time-gap between the backward-timing and the nest backward-timing.

Alternatively, preferably, the plurality of first forward pulse-waiting-times and the plurality of second forward pulse-waiting-times are respectively defined correspondingly to the respective forward-timings in such a manner that a plurality of drops of liquid can be jetted at predetermined positions symmetric with respect to respective intermediate positions between adjacent two passage-positions of the head member, the respective passage-positions corresponding to the respective forward-timings; and the plurality of first backward pulse-waiting-times and the plurality of second backward pulse-waiting-times are respectively defined correspondingly to the respective backward-timings in such a manner that a plurality of drops of liquid can be jetted at predetermined positions symmetric with respect to respective intermediate positions between adjacent two passage-positions of the head member, the respective passage-positions corresponding to the respective backward-timings.

In addition, preferably, the liquid jetting apparatus further includes a supporting member that can support a medium, onto which liquid is to be jetted, in such a manner that the medium can face the nozzle of the head member moved forward and backward and that the medium is spaced away from the nozzle by substantially the same gap; a position on the medium which a drop of liquid jetted by means of a first forward pulse-wave reaches substantially coincides with a position on the medium which a drop of liquid jetted by means of a second backward pulse-wave reaches, with respect to a direction in which the head member is moved forward and backward; and a position on the medium which a drop of liquid jetted by means of a second forward pulse-wave reaches substantially coincides with a position on the medium which a drop of liquid jetted by means of a first backward pulse-wave reaches, with respect to the direction in which the head member is moved forward and backward.

In addition, another liquid jetting apparatus of the, invention includes: a head member having a nozzle; a pressure-changing unit that can cause pressure of liquid in the nozzle to change in such a manner that the liquid is jetted from the nozzle; a reciprocating mechanism that can move the head member forward and backward at a variable speed in such a manner that the head member passes through a plurality of predetermined passage-positions; a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head member is moved forward, and that can cause the pressure-changing unit to operate based on the backward driving pulse while the head member is moved backward; wherein: a plurality of first forward pulse-waiting-times are respectively defined correspondingly to the respective forward-timings; a plurality of second forward pulse-waiting-times are also respectively defined correspondingly to the respective for d-timings; a plurality of third forward pulse-waiting-times are also respectively defined correspondingly to the respective forward-timings; a plurality of first backward pulse-waiting-times are respectively defined correspondingly to the respective backward-timings; a plurality of second backward pulse-waiting-times are also respectively defined correspondingly to the respective backward-timings; a plurality of third backward pulse-waiting-times are also respectively defined correspondingly to the respective backward-timings; the forward jetting-driving signal includes a plurality of forward first pulse-waves that respectively rise up or fall down when the respective first forward pulse-waiting-times have passed since the respective forward-timings, a plurality of forward second pulse-waves that respectively rise up or fall down when the respective second forward pulse-waiting-times have passed since the respective forward-timings, and a plurality of forward third pulse-waves that respectively rise up or fall down when the respective third forward pulse-waiting-times have passed since the respective forward-timings; the backward jetting-driving signal includes a plurality of backward first pulse-waves that respectively rise up or fall down when the respective first backward pulse-waiting-times have passed since the respective backward-timings, a plurality of backward second pulse-waves that respectively rise up or fall down when the respective second backward pulse-waiting-times have passed since the respective backward-timings, and a plurality of backward third pulse-waves that respectively rise up or fall down when the respective third backward pulse-waiting-times have passed since the respective backward-timings; each forward first pulse-wave and each backward third pulse-wave have the same waveform; each forward second pulse-wave and each backward second pulse-wave have the same waveform; and each forward third pulse-wave and each backward first pulse-wave have the same waveform.

According to the feature, as the plurality of first forward pulse-waiting-times, the plurality of second forward pulse-waiting-times and the plurality of third forward pulse-waiting-times are respectively defined correspondingly to the respective forward-timings, and the plurality of first backward pulse-waiting-times, the plurality of second backward pulse-waiting-times and the plurality of third backward pulse-waiting-times are respectively defined correspondingly to the respective backward-timings, even if a moving speed of the head member is not constant, positions at which three drops of liquid are jetted in each image unit can be adjusted to be always constant.

Similarly, even if the forward jetting-driving signal and/or the backward jetting-driving signal include a plurality of four or more pulse-waves, positions at which four or more drops of liquid are jetted in each image unit can be adjusted to be always constant.

In addition, this invention is a controlling unit that can control a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising: a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head member is moved forward, and that can cause the pressure-changing unit to operate based on the backward driving pulse while the head member is moved backward; wherein a plurality of forward pulse-waiting-times are respectively defined correspondingly to the respective forward-timings; a plurality of backward pulse-waiting-times are respectively defined correspondingly to the respective backward-timings; the forward jetting-driving signal includes a plurality of forward pulse-waves that respectively rise up or fall down when the respective forward pulse-waiting-times have passed since the respective forward-timings; the backward jetting-driving signal includes a plurality of backward pulse-waves that respectively rise up or fall down when the respective backward pulse-waiting-times have passed since the respective backward-timings; and each forward pulse-wave and each backward pulse-wave have the same waveform.

In addition, this invention is a controlling unit that can control a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising: a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head member is moved forward, and that can cause the pressure-changing unit to operate based on the backward driving pulse while the head member is moved backward; wherein: a plurality of first forward pulse-waiting-times are respectively defined correspondingly to the respective forward-timings; a plurality of second forward pulse-waiting-times are also respectively defined correspondingly to the respective forward-timings; a plurality of first backward pulse-waiting-times are respectively defined correspondingly to the respective backward-timings; a plurality of second backward pulse-waiting-times are also respectively defined correspondingly to the respective backward-timings; the forward jetting-driving signal includes a plurality of forward first pulse-waves that respectively rise up or fall down when the respective first forward pulse-waiting-times have passed since the respective forward-timings, and a plurality of forward second pulse-waves that respectively rise up or fall down when the respective second forward pulse-waiting-times have passed since the respective forward-timings; the backward jetting-driving signal includes a plurality of backward first pulse-waves that respectively rise up or fall down when the respective first backward pulse-waiting-times have passed since the respective backward-timings, and a plurality of backward second pulse-waves that respectively rise up or fall down when the respective second backward pulse-waiting-times have passed since the respective backward-timings; each forward first pulse-wave and each backward second pulse-wave have the same waveform; and each forward second pulse-wave and each backward first pulse-wave have the same waveform.

In addition, this invention is a controlling unit that can control a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising: a forward-driving-signal generator that can generate a forward jetting-driving signal, based on a plurality of forward-timings respectively defined correspondingly to the plurality of predetermined passage-positions while the head member is moved forward; a forward-driving-pulse generator that can generate a forward driving pulse based on the forward jetting-driving signal; a backward-driving-signal generator that can generate a backward jetting-driving signal, based on a plurality of backward-timings respectively defined correspondingly to the plurality of predetermined passage-positions while the head member is moved backward; a backward-driving-pulse generator that can generate a backward driving pulse based on the backward jetting-driving signal; and a main controller that can cause the pressure-changing unit to operate based on the forward driving pulse while the head member is moved forward, and that can cause the pressure-changing unit to operate based on the backward driving pulse while the head member is moved backward; wherein: a plurality of first forward pulse-waiting-times are respectively defined correspondingly to the respective forward-timings; a plurality of second forward pulse-waiting-times are also respectively defined correspondingly to the respective forward-timings; a plurality of third forward pulse-waiting-times are also respectively defined correspondingly to the respective forward-timings; a plurality of first backward pulse-waiting-times are respectively defined correspondingly to the respective backward-timings; a plurality of second backward pulse-waiting-times are also respectively defined correspondingly to the respective backward-timings; a plurality of third backward pulse-waiting-times are also respectively defined correspondingly to the respective backward-timings; the forward jetting-driving signal includes a plurality of forward first pulse-waves that respectively rise up or fall down when the respective first forward pulse-waiting-times have passed since the respective forward-timings, a plurality of forward second pulse-waves that respectively rise up or fall down when the respective second forward pulse-waiting-times have passed since the respective forward-timings, and a plurality of forward third pulse-waves that respectively rise up or fall down when the respective third forward pulse-waiting-times have passed since the respective forward-timings; the backward jetting-driving signal includes a plurality of backward first pulse-waves that respectively rise up or fall down when the respective first backward pulse-waiting-times have passed since the respective backward-timings, a plurality of backward second pulse-waves that respectively rise up or fall down when the respective second backward pulse-waiting-times have passed since the respective backward-timings, and a plurality of backward third pulse-waves that respectively rise up or fall down when the respective third backward pulse-waiting-times have passed since the respective backward-timings; each forward first pulse-wave and each backward third pulse-wave have the same waveform; each forward second pulse-wave and each backward second pulse-wave have the same waveform; and each forward third pulse-wave and each backward first pulse-wave have the same waveform.

A computer system can materialize each of the controlling units or any element of each of the controlling units.

This invention includes a storage unit capable of being read by a computer, storing a program for materializing each controlling unit or any element in a computer system.

This invention also includes the program itself for materializing each controlling unit or any element in the computer system.

This invention includes a storage unit capable of being read by a computer, storing a program including a command for controlling a second program executed by a computer system including a computer, the program being executed by the computer system to control the second program to materialize each controlling unit or any element.

This invention also includes the program itself including the command for controlling the second program executed by the computer system including the computer, the program being executed by the computer system to control the second program to materialize each controlling unit or any element.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

Figure 1:
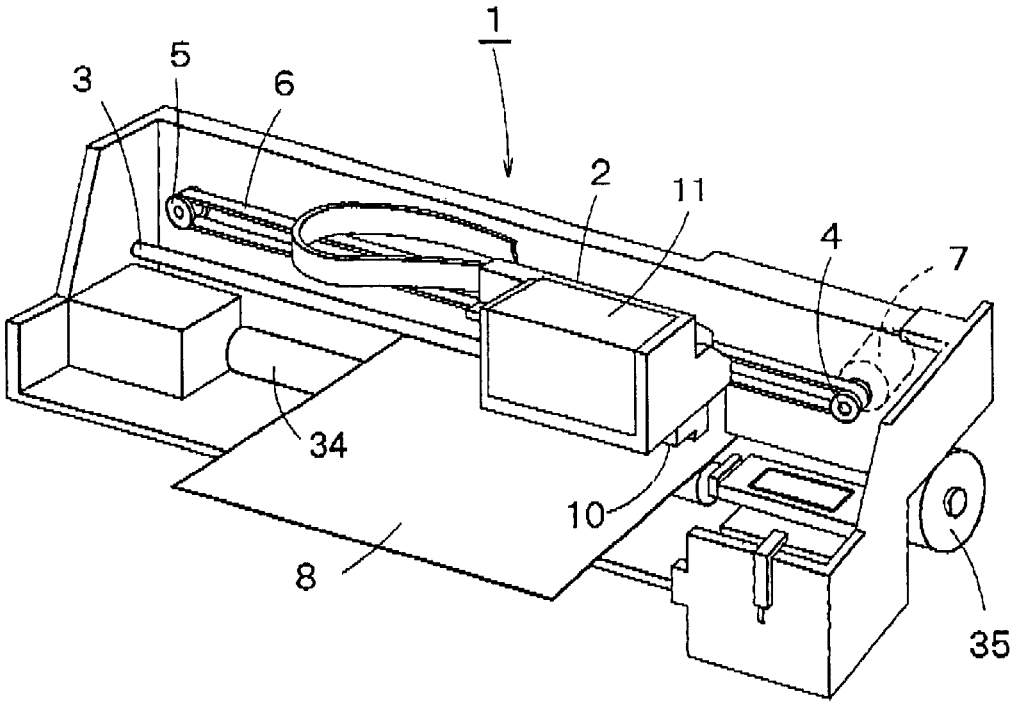
FIG. 1 is a schematic perspective view of an ink-jetting printer of a first embodiment according to the invention.

FIG. 1 is a schematic perspective view of an ink-jetting printer 1 as a liquid jetting apparatus of a first embodiment according to the invention. In the ink-jetting printer 1, a carriage 2 is slidably mounted on a guide bar (guide member) 3. The carriage 2 is connected to a timing belt 6, which goes around a driving pulley 4 and a free pulley 5. The driving pulley 4 is connected to a rotational shaft of a pulse motor 7. Thus, the carriage 2 can be reciprocated along a direction of width of a recording paper 8 by driving the pulse motor 7 (main scanning).

A recording head (head member) 10 is mounted under the carriage 2. The recording head 10 mounted under the carriage 2 is adapted to face down to the recording paper 8.

Figure 2:
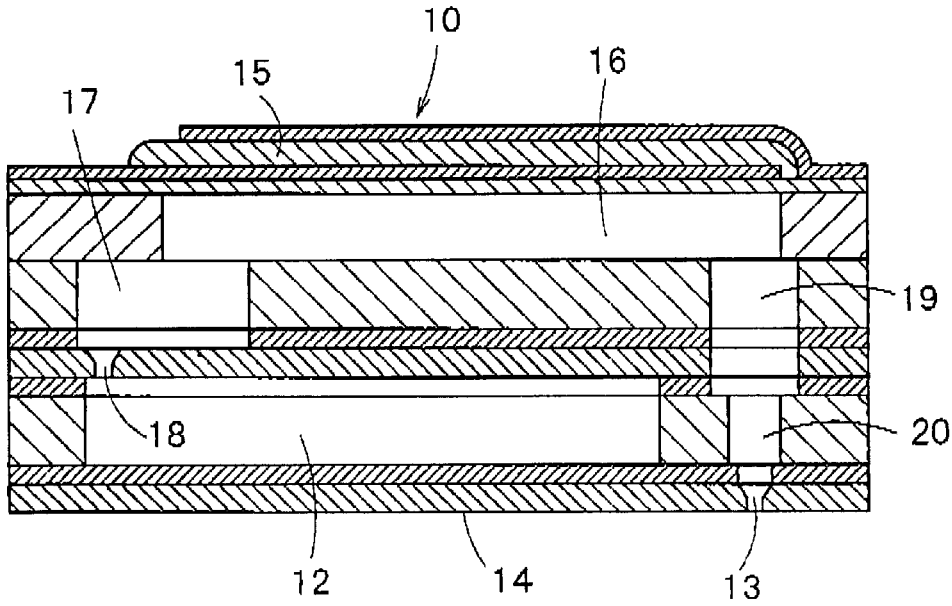
FIG. 2 is a sectional view of an example of a recording head.

As shown in FIG. 2, the recording head 10 mainly has: an ink chamber 12 to which an ink is supplied from an ink cartridge 11 (see FIG. 1); a nozzle plate 14 provided with a plurality of (for example 64) nozzles 13 in a sub-scanning direction; and a plurality of pressure chambers 16 communicated with the plurality of nozzles 13, respectively. Each of the plurality of pressure chambers 16 is adapted to be caused to expand and contract by deformation of a piezoelectric vibrating member 15.

The ink chamber 12 and the plurality of pressure chambers 16 are communicated via a plurality of ink supplying holes 18 and a plurality of supply side communication holes 17, respectively. The plurality of pressure chambers 16 and the plurality of nozzles 13 are communicated via a plurality of first nozzle side communication holes 19 and a plurality of second nozzle side communication holes 20, respectively. Thus, for each of the plurality of nozzles 13, an ink passage is formed from the ink chamber 12 to each of the plurality of nozzles 13 via each of the plurality of pressure chambers 16.

The nozzle plate 14 in the embodiment is formed as an ink-repellent nozzle plate 14. The ink-repellent nozzle plate 14 has a uniformly formed ink-repellent film on a surface of a base plate. The ink-repellent nozzle plate 14 is provided with the plurality of nozzles 13, each of which is a through opening.

The through opening (nozzle 13) has a smaller diameter at an outside surface of the nozzle plate 14 which faces the recording paper 8, and a larger diameter at the side of the corresponding second nozzle communication hole 20. Thus, an inside surface of the through opening is funnel-like or conical. The ink-repellent film is formed on at least the outside surface of the nozzle plate 14.

In the embodiment, each of the piezoelectric vibrating members 15 is adapted to cause each of the pressure chambers 16 to expand or contract by distortion thereof. Thus, when the electric power (potential) is supplied to a piezoelectric vibrating member 15, the piezoelectric vibrating member 15 is charged and contracts in a direction perpendicular to a direction of the electric field. Then, a pressure chamber 16 corresponding to the piezoelectric vibrating member 15 is caused to contract. When the electric charges are discharged from the piezoelectric vibrating member 15, the piezoelectric vibrating member 15 extends in the direction perpendicular to the direction of the electric field. Then, a pressure chamber 16 corresponding to the piezoelectric vibrating member 15 is caused to expand.

That is, in the recording head 10, a volume of the pressure chamber 16 may be changed by the corresponding piezoelectric vibrating member 15 charged or discharged. This may cause pressure of the ink in the pressure chamber 16 to change, so that a drop of the ink may be jetted from the corresponding nozzle 13.

Another type of piezoelectric vibrating member which may expand and contract in a longitudinal direction thereof can be also used, instead of the piezoelectric vibrating member 15 causing the corresponding pressure chamber 16 to expand or contract by distortion thereof. In the case, the corresponding pressure chamber can expand by deformation of the piezoelectric vibrating member when the piezoelectric vibrating member is charged, and can contract by deformation of the piezoelectric vibrating member when the piezoelectric vibrating member is discharged. When the longitudinal-vibrating type of piezoelectric vibrating member is used, compared with the case wherein the distortion-vibrating type of piezoelectric vibrating member 15 is used, the rising and the falling of a waveform described below are opposite.

In the printer 1 as described above, a drop of the ink may be jetted from the recording head 10 synchronously with each of forward and backward the main scanning of the carriage 2, during a recording operation. A platen 34 may be rotated so that the recording paper 8 is fed in a feeding (sub-scanning) direction by a predetermined width of line every when the direction of the main scanning of the carriage 2 is switched between forward and backward. As a result, an image including characteristics or the like is recorded on the recording paper 8, based on recording data.

Figure 3:
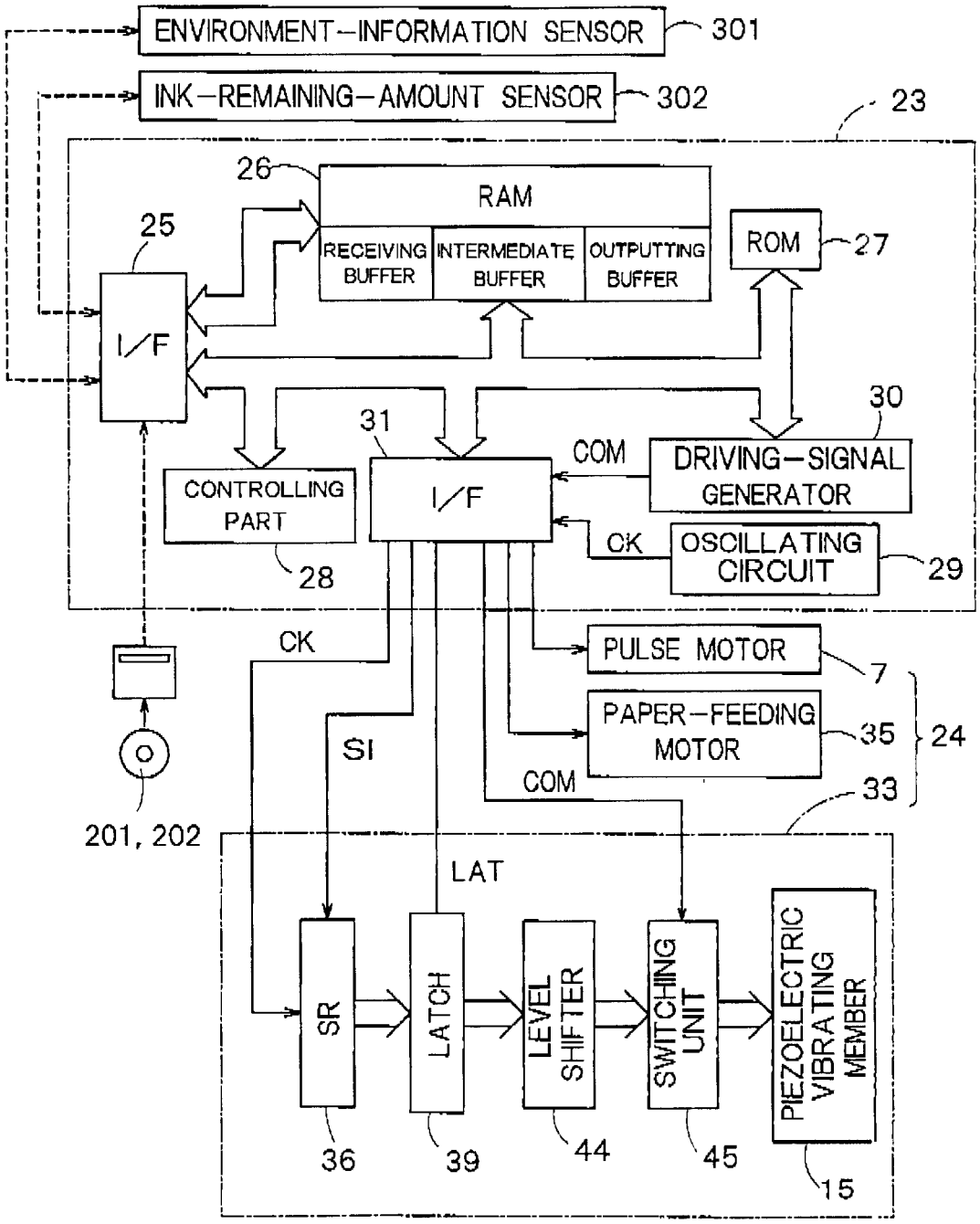
FIG. 3 is a schematic block diagram for explaining an electric structure of the ink-jetting printer.

Then, an electric structure of the ink-jetting printer 1 is explained. As shown in FIG. 3, the printer 1 has a printer controller 23 and a printing engine 24.

The printer controller 23 has: an outside interface (outside I/F) 25; a RAM 26 for temporarily storing various data; a ROM 27 storing a controlling program or the like; a main controller 28 including a CPU or the like; a oscillating circuit 29 for generating a clock signal (CK); a driving-signal generating circuit 30 for generating driving signals (COM) for supplying to the recording head 10, which is described below in detail; and an inside interface (inside I/F) 31 for transmitting the driving signals, dot pattern data (bit map data) developed based on printing data (recording data) or the like to the printing engine 24.

The outside I/F 25 is adapted to receive the printing data consisting of character codes, graphic functions, image data or the like, from a host computer (not shown) or the like. In addition, the outside I/F 25 is adapted to output a busy signal (BUSY) and/or an acknowledge signal (ACK) to the host computer or the like.

The RAM 26 has a receiving buffer, an intermediate buffer, an outputting buffer and a work memory (not shown). The receiving buffer can temporarily store the printing data received via the outside I/F 25. The intermediate buffer can store intermediate code data converted by the main controller 28. The outputting buffer can store dot pattern data. The dot pattern data mean printing data obtained by decoding (translating) the intermediate code data (for example level data).

The ROM 27 stores font data, graphic functions or the like as well as the controlling program for conducting various data processing.

The main controller 28 is adapted to conduct various controls according to the controlling program stored in the ROM 27. For example, the main controller 28 reads out the printing data in the receiving buffer, converts the printing data into the intermediate code data, and causes the intermediate buffer to store the intermediate code data. In addition, the main controller 28 analyzes the intermediate code data read out from the intermediate buffer, and develops (decodes) the intermediate code data into the dot pattern data with reference to the font data and the graphic functions or the like stored in the ROM 27. Then, the main controller 28 conducts necessary decoration processes to the dot pattern data, and causes the outputting buffer to store the dot pattern data.

After dot pattern data for one line, which correspond to one main scanning of the recording head 10, are obtained, the dot pattern data for the one line is outputted in turn from the outputting buffer to the recording head 10 via the inside I/F 31. When the dot pattern data for the one line is outputted from the outputting buffer, the intermediate code data that have already been developed are erased from the intermediate buffer. Then, the next intermediate code data start to be developed.

Next, the printing engine 24 has: a paper-feeding motor 35 as a paper-feeding mechanism; the pulse motor 7 as a carriage-moving mechanism; and an electric driving system 33 for the recording head 10. The paper-feeding motor 35 causes the platen 34 (see FIG. 1) to rotate in order to feed the recording paper 8. The pulse motor 7 causes the carriage 2 to move via the timing belt 6.

As shown in FIG. 3, the electric driving system 33 for the recording head 10 has; a shift-register circuit 36; a latch circuit 39; a level shifter 44; a switching circuit 45; and the piezoelectric vibrating members 15; which are electrically connected in the order.

Figure 4:
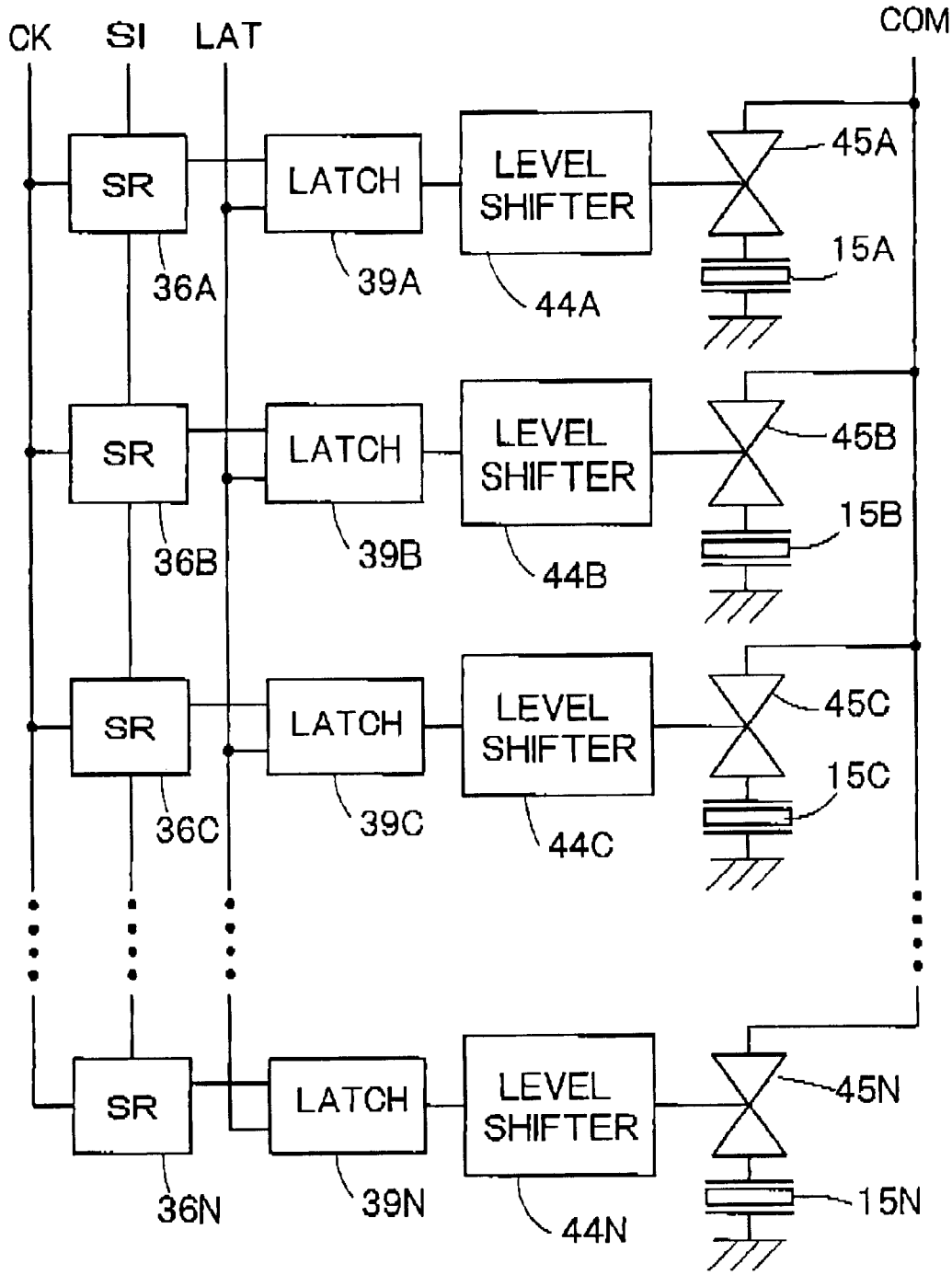
FIG. 4 is a schematic block diagram for explaining an electric driving structure of the recording head.

As shown in FIG. 4, the shift-register circuit 36 has a plurality of shift-register devices 36A to 36N, each of which corresponds to each of the nozzles 13 of the recording head 10. The latch-circuit 39 has a plurality of latch-circuit devices 39A to 39N, each of which corresponds to each of the nozzles 13 of the recording head 10. The level shifter 44 has a plurality of level-shifter devices 44A to 44N, each of which corresponds to each of the nozzles 13 of the recording head 10, The switching circuit 45 has a plurality of switching circuit devices 45A to 45N, each of which corresponds to each of the nozzles 13 of the recording head 10. Each of the piezoelectric vibrating members 15 corresponds to each of the nozzles 13. Thus, the piezoelectric vibrating members 15 are also designated as piezoelectric vibrating members 15A to 15N.

According to the electric driving system 33, the recording head 10 can jet a drop of the ink, based on the printing data from the printer controller 23. The printing data (SI) from the printer controller 23 are transmitted in a serial manner to the shift-register 36 via the inside I/F 31, synchronously with the clock signal (CK) from the oscillating circuit 29.

The printing data from the printer controller 23 are set for each of printing dots, that is, each of the nozzles 13. Then, the printing data for all the nozzles 13 are inputted in the shift-register devices 36A to 36N, respectively.

As shown in FIGS. 3 and 4, the shift-register devices 36A to 36N are electrically connected to the latch-circuit devices 39A to 39N, respectively. When the latch signals (LAT) from the printer controller 23 are inputted to the latch-circuit devices 39A to 39N, the latch-circuit devices 39A to 39N latch the printing data.

As described above, a circuit unit consisting of the shift-register 36 and the latch-circuit 39 may function as a storing circuit. That is, this storing circuit can temporarily store the printing data before inputted to the level shifter 44.

The printing data latched in the latch-circuit 39 are inputted to the level shifter 44 (respective level shifter devices 44A to 44N) at respective timings defined by timing signals, which are described below.

The level shifter 44 is adapted to function as a voltage amplifier. For example, when a bit of the printing data is "1", the level shifter 44 raises the datum "1" to a voltage of several decade volts that can drive the switching circuit 45 (respective switching circuit devices 45A to 45N).

The raised datum is applied to the switching circuit 45, which may function as a driving-pulse generator and a main controller. That is, the switching circuit 45 selects and generates one or more driving pulses from the driving signal (COM), based on the printing data. The generated one or more driving pulses are supplied to the piezoelectric vibrating member 15. For the purpose, input terminals of the switching circuit devices 45A to 45N are adapted to be supplied the driving signal (COM) from the driving-signal generator 30, and output terminals of the switching circuit devices 45A to 45N are connected to the piezoelectric vibrating members 15A to 15N, respectively.

Each of the switching devices 45A to 45N is controlled by the printing data. That is, a switching device of 45A to 45N is closed (connected) when a bit of the printing data is 1. Then, the corresponding driving pulse is supplied to the corresponding piezoelectric vibrating member 15. Thus, an electric-potential level of the piezoelectric vibrating member 15 is changed.

On the other hand, when a bit of the printing data is "0", a level shifter device of 44A to 44N does not output an electric signal for operating the corresponding switching circuit device of 45A to 45N. Then, the switching circuit device is not connected, so that the corresponding driving pulse (pulse-wave) is not supplied to the corresponding piezoelectric vibrating member 15. While a bit of the printing data is "0", the piezoelectric vibrating member 15 holds a previous electric charges. That is, an electric-potential level of the piezoelectric vibrating member 15 is maintained.

Figure 5A:
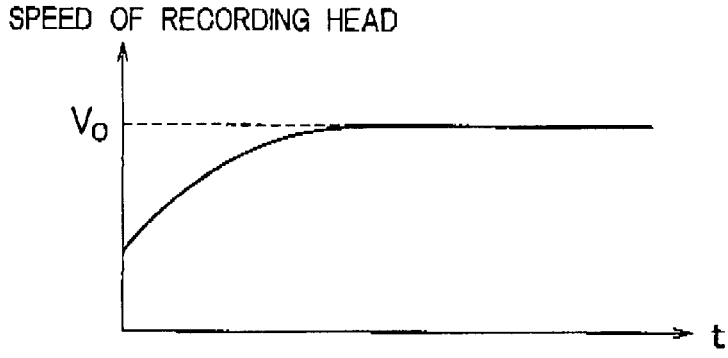
FIGS. 5A and 5B are graphs for explaining an example of a forward-moving state of the recording head.
Figure 5B:
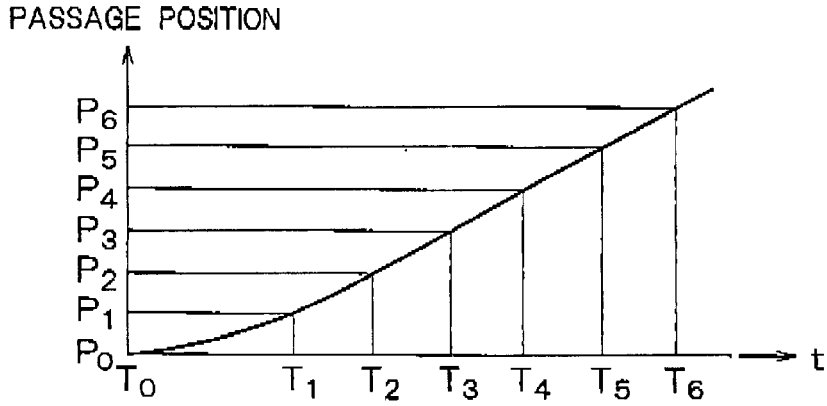
Figure 5C:
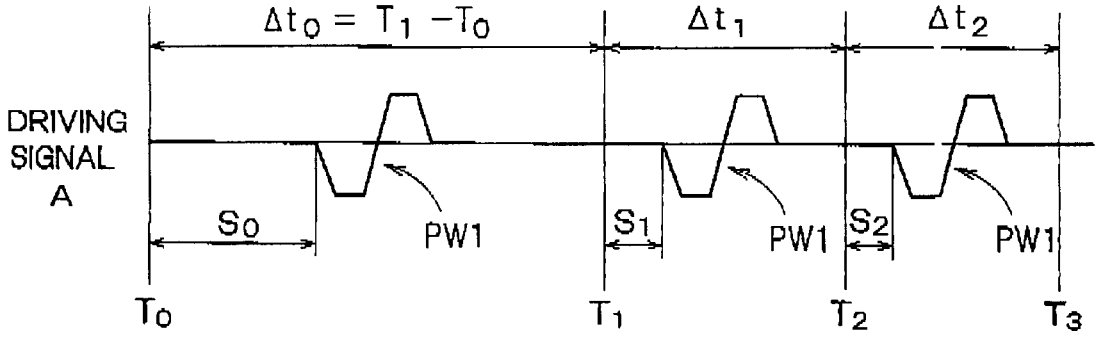
FIG. 5C is a diagram of an example of a forward driving signal, which corresponds to the forward-moving state of the recording head-shown in FIGS. 5A and 5B.

An example of a forward jetting-driving signal is shown in FIG. 5C. The jetting-driving signal A shown in FIG. 5C corresponds to a forward-moving state of the recording lead 10 shown in FIGS. 5A and 5B, and includes a plurality of forward pulse-waves PW1 that respectively fall down when respective forward pulse-waiting-times $S_n$ have passed since respective forward-timings $T_n$, which are described below. In the driving signal A, the forward pulse-wave PW1 is a small-dot driving pulse DP1 for jetting a small drop of the ink from the nozzle 13.

The forward pulse-waiting-times $S_n$ are respectively defined correspondingly to the respective forward-timings $T_n$.

Figure 6:
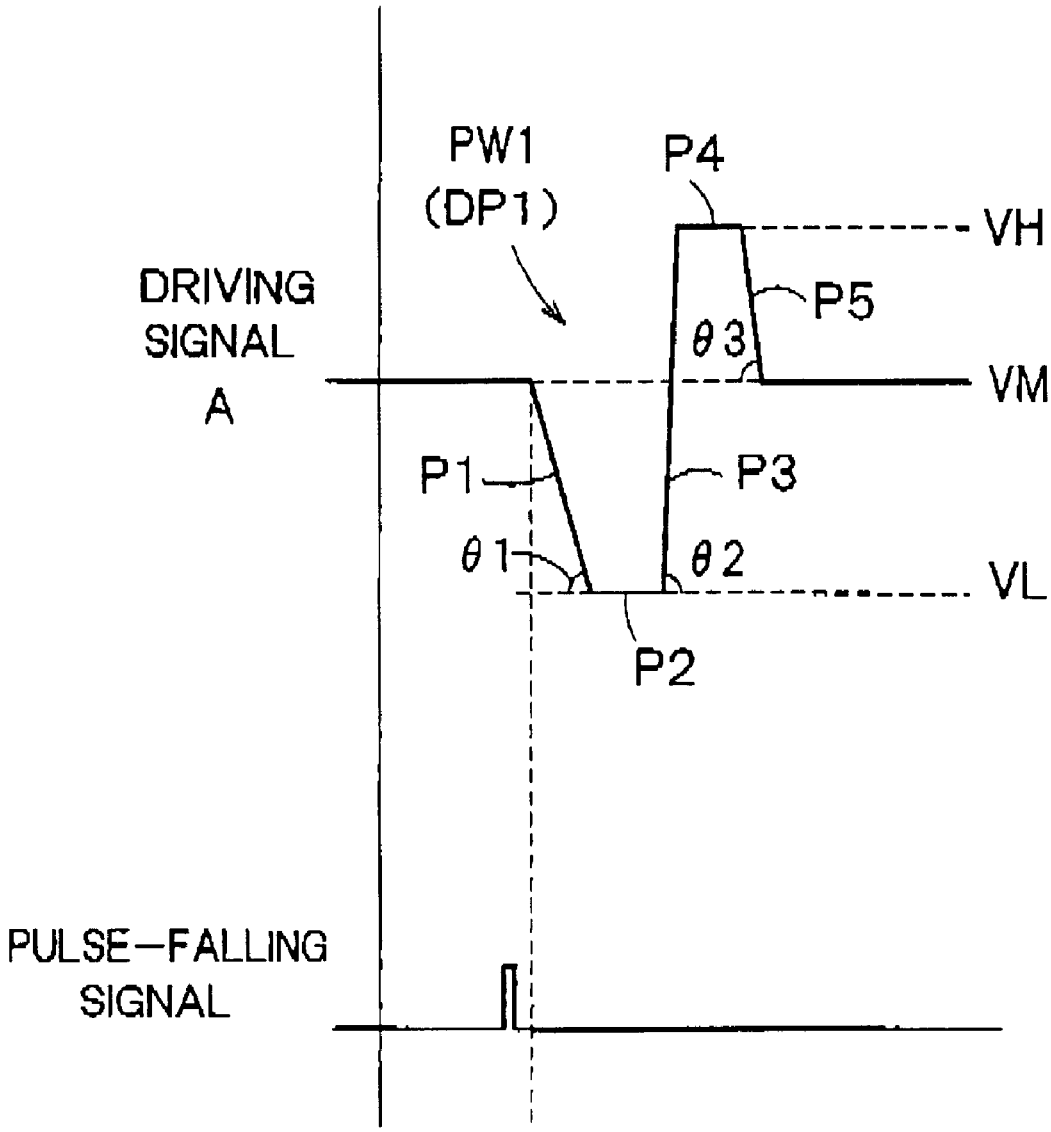
FIG. 6 is a diagram for explaining a driving pulse in detail.

As shown in FIG. 6, the driving pulse DP1 includes: a first discharging element P1 falling from a middle electric potential VM to a lowest electric potential VL at an incline θ1, a first holding element P2 maintaining the lowest electric potential VL for a very short time, a first charging element P3 rising from the lowest electric potential VL to a highest electric potential VH at a steep incline θ2 within a very short time, a second holding element P4 maintaining the highest electric potential VH for a time, and a second discharging element P5 falling from the highest electric potential VH to the middle electric potential VM at an incline θ3. (If the piezoelectric vibrating member is longitudinal-vibrating mode, the above waveform is opposite with respect to positive and negative.)

When the driving-pulse DP1 is supplied to the piezoelectric vibrating member 15, a drop of the ink, whose volume corresponds to a small dot, is jetted from the nozzle 13.

In detail, when the first discharging element P1 is supplied to the piezoelectric vibrating member 15, the piezoelectric vibrating member 15 is discharged from the middle electric potential VM. Then, the corresponding pressure chamber 16 is caused to expand from a standard volume thereof to a maximum volume thereof. Then, by the first charging element P3, the pressure chamber 16 is caused to rapidly contract to a minimum volume thereof. Such a contracting state of the pressure chamber 16 is maintained while the second holding element P4 is supplied to the piezoelectric vibrating member 15. The rapid contraction and the keeping of the contracting state of the pressure chamber 16 raise a pressure of the ink in the pressure chamber 16 so rapidly that a small drop of the ink is jetted from the nozzle 13. Then, by the second discharging element P5, the pressure chamber 16 is caused to expand back to an original state thereof in order to settle down a vibration of a meniscus of the ink at the nozzle 13 within a short time.

Figure 7A:
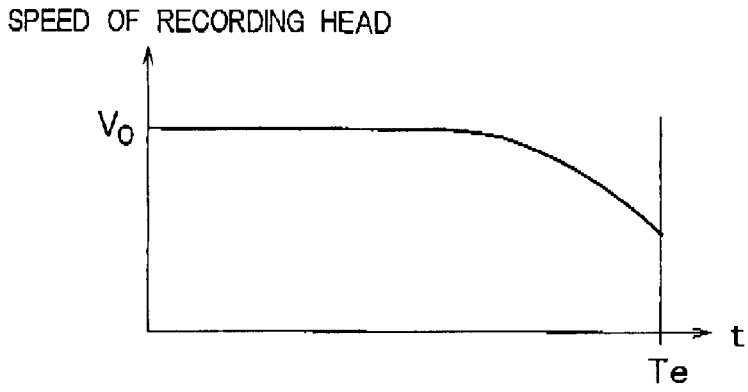
FIGS. 7A and 7B are graphs for explaining an example of a backward-moving state of the recording head.
Figure 7B:
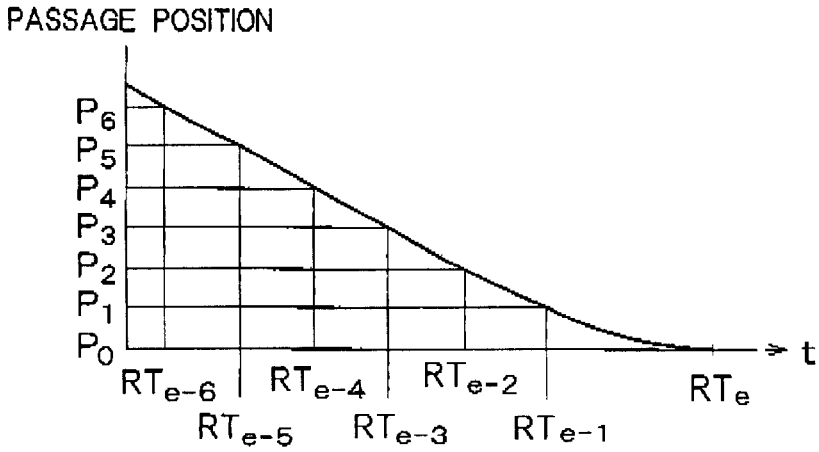
Figure 7C:
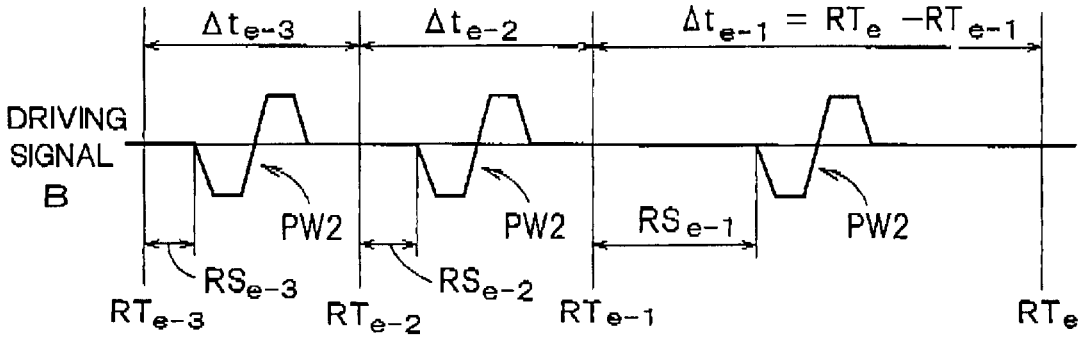
FIG. 7C is a diagram of an example of a backward driving signal, which corresponds to the backward-moving state of the recording head shown in FIGS. 7A and 7B.

Then, a preferable example of a backward jetting-driving signal is shown in FIG. 7C. The jetting-driving signal B shown in FIG. 7C corresponds to a backward-moving state of the recording head 10 shown in FIGS. 7A and 7B, and includes a plurality of backward pulse-waves PW2 that respectively fall down when respective backward pulse-waiting-times $RS_n$ have passed since respective backward-timings $RT_n$, which are described below. In the driving signal B, the backward pulse-wave PW2 has the same waveform as the forward pulse-wave PW1 in the driving signal A, and is a small-dot driving pulse DP1 for jetting a small drop of the ink from the nozzle 13.

The backward pulse-waiting-times $RS_n$ are respectively defined correspondingly to the respective backward-timings $RT_n$.

Figure 8:
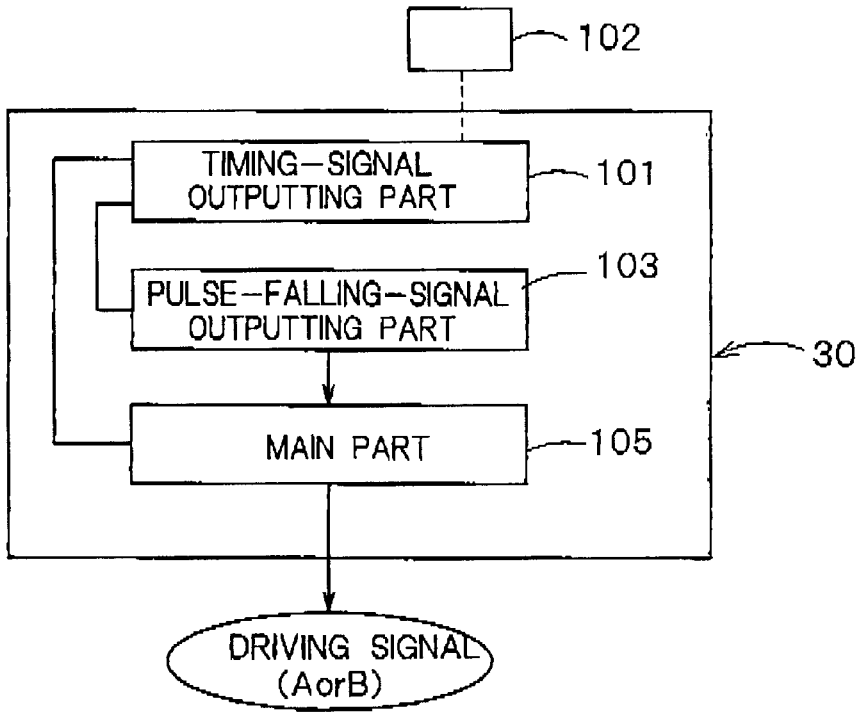
FIG. 8 is a schematic block diagram for explaining a driving-signal generating circuit.

Herein, the driving-signal generating circuit 30 is explained in detail with reference to FIG. 8. As shown in FIG. 8, the driving-signal generating circuit 30 has a timing-signal outputting part 101 that outputs a plurality of timing signals (forward timing signals and backward timing signals) synchronously with passage-timings ($T_n$, $RT_n$) of respective passage-positions by the recording head 10. The timing-signal outputting part 101 is connected to an encoder 102 that detects a position or a moving amount (distance) of the recording head 10, in order to synchronize with the passage-timings of the respective passage-positions by the recording head 10. Each passage-position is defined for each recording pixel (image unit). The encoder 102 may be replaced with another unit including: a linear encoder supported by a printer housing in such a manner that the linear encoder extends in a direction of width of the recording paper (in the main scanning direction), and a slit detector mounted on the carriage or the like and capable of detecting a plurality of slits of the linear encoder.

The driving-signal generating circuit 30 also has a pulse-falling-signal outputting part 103 that outputs a pulse-falling signal when the corresponding forward pulse-waiting-time $S_n$ has passed after each forward timing signal, during a forward movement of the recording head 10, based on the forward pulse-waiting-times $S_n$ that are respectively defined correspondingly to the respective forward timing signals.

In addition, the pulse-falling-signal outputting part 103 is adapted to output a pulse-falling signal when the corresponding backward pulse-waiting-time $RS_n$ has passed after each backward timing signal, during a backward movement of the recording head 10, based on the backward pulse-waiting-times $RS_n$ that are respectively defined correspondingly to the respective backward timing signals.

The pulse-falling-signal outputting part 103 of this embodiment is adapted to respectively define the forward pulse-waiting-times $S_n$ correspondingly to the respective forward-timings, dependently on a forward-moving state of the recording head 10 by means of the pulse motor 7 (reciprocating mechanism). Concretely, in this embodiment, the forward pulse-waiting-times $S_n$ are respectively determined correspondingly to the respective forward-timings, based on a predetermined acceleration-deceleration curve, according to which the recording head 10 is to be moved forward, stored (set) in the ROM 27 in advance (see FIG. 5A). The acceleration-deceleration curve may be set and/or stored as a data table, a function or the like.

Similarly, the pulse-falling-signal outputting part 103 of this embodiment is adapted to respectively define the backward pulse-waiting-times $RS_n$ correspondingly to the respective backward-timings, dependently on a backward-moving state of the recording head 10 by means of the pulse motor 7 (reciprocating mechanism). Concretely, in this embodiment, the backward pulse-waiting-times $RS_n$ are respectively determined correspondingly to the respective backward-timings, based on a predetermined acceleration-deceleration curve, according to which the recording head 10 is to be moved backward, stored (set) in the ROM 27 in advance (see FIG. 7A).

The timing-signal outputting part 101 and the pulse-falling-signal outputting part 103 are connected to a main part 105 (forward-driving-signal generator and backward-driving-signal generator).

The main part 105 is adapted to generate the driving signal A in which the plurality of forward pulse-waves PW1 appear in turn synchronously with outputting timings of the respective pulse-falling signals, after the respective forward-timings $T_n$ (outputting timings of the timing signals), during the forward movement of the recording head 10 (see FIGS. 5C and 6).

On the other hand, during the backward movement of the recording head 10, the main part 105 is adapted to generate the driving signal B in which the plurality of backward pulse-waves PW2 appear in turn synchronously with outputting timings of the respective pulse-falling signals, after the respective backward-timings $RT_n$ (outputting timings of the timing signals) (see FIG. 7C).

Then, if a bit of the printing data at a forward-timing is "1", the switching circuit 45 (driving-pulse generator) is closed (connected) from the forward-timing to the next forward-timing.

Thus, based on the dot-pattern data, the first driving pulse DP1 is supplied to the corresponding piezoelectric vibrating member 15. As a result, correspondingly to the dot-pattern data, one small-volume drop of the ink is jetted from the nozzle 13. Thus, a small dot is formed on the recording paper 8.

Similarly, if a bit of the printing data at a backward-timing is "1", the switching circuit 45 (driving-pulse generator) is closed (connected) from the backward-timing to the next backward-timing.

Thus, based on the dot-pattern data, the first driving pulse DP1 is supplied to the corresponding piezoelectric vibrating member 15. As a result, correspondingly to the dot-pattern data, one small-volume drop of the ink is jetted from the nozzle 13. Thus, a small dot is formed on the recording paper 8.

Figure 9:
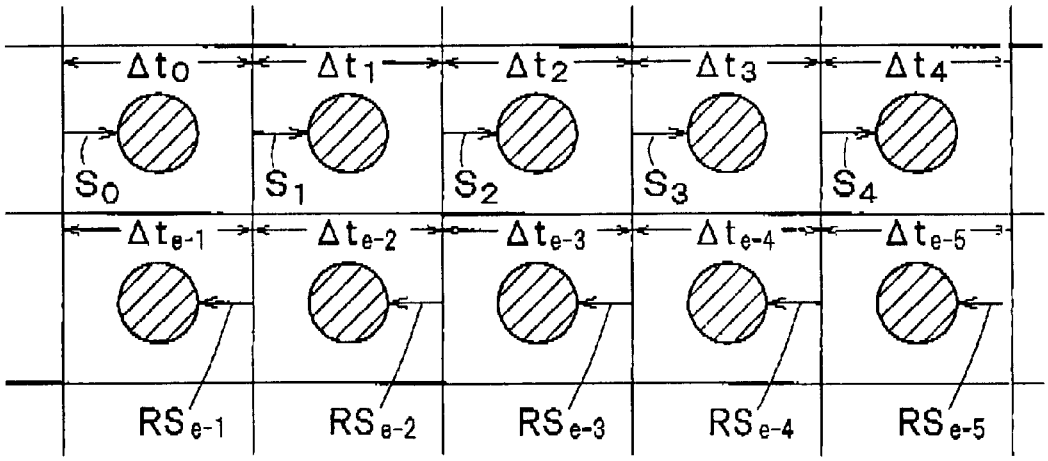
FIG. 9 is a view showing respective positions which a plurality of drops of ink reach during a forward movement and respective positions which a plurality of drops of ink reach during a backward movement, according to an embodiment of the invention.

Then, as shown in FIG. 9, positions on the recording paper 8, which the jetted drops of the ink reach in the main scanning direction while the recording head 10 is moved forward, substantially coincide with positions on the recording paper 8, which the jetted drops of the ink reach in the main scanning direction while the recording head 10 is moved backward. Thus, the positions that the jetted drops of the ink reach may be aligned in the sub-scanning direction, so that much higher printing accuracy can be achieved.

According to the above driving signals, even if the moving speed of the recording head 10 is accelerated or decelerated so that positions which the jetted drops of the ink reach may not be aligned, generation of a Bi-D gap can be prevented. Thus, much higher printing accuracy can be achieved with much less uneven or irregular printing portions.

Especially, according to the above embodiment, the forward jetting-driving signal is generated correspondingly to the forward-moving state of the recording head 10 and the backward jetting-driving signal is generated correspondingly to the backward-moving state of the recording head 10. Thus, even if the forward-moving state of the recording head 10 and the backward-moving state of the recording head 10 include the same or different acceleration and/or deceleration states, generation of a Bi-D gap can be effectively prevented.

In the above embodiment, the pulse-falling-signal outputting part 103 is adapted to respectively determine the forward pulse-waiting-times $S_n$ and the backward pulse-waiting-times $RS_n$ correspondingly to the respective forward-timings and the respective backward-timings, based on the acceleration-deceleration curve for the recording head 10 to be moved forward and the acceleration-deceleration curve for the recording head 10 to be moved backward, which are stored (set) in the ROM 27 in advance.

However, the pulse-falling-signal outputting part 103 may respectively determine the forward pulse-waiting-times $S_n$ correspondingly to the respective forward-timings $T_n$, based on respective speeds $v_n$ of the recording head 10 obtained at the respective forward-timings $T_n$. That is, the forward pulse-waiting-times $S_n$ may be obtained from an expression $S_n=f(v_n)$. In order to obtain the speed $v_n$ of the recording head 10, a differentiator, which may be mounted on the encoder 102, may be used. In addition, any other known way may be adopted to obtain the speed $v_n$ of the recording head 10. If a calculating time is taken into consideration, another expression $S_n=f(v_{n-1})$ or the like may be used.

Similarly, the pulse-falling-signal outputting part 103 may respectively determine the backward pulse-waiting-times $RS_n$ correspondingly to the respective backward-timings $RT_n$, based on respective speeds $v_n$ of the recording head 10 obtained at the respective backward-timings $RT_n$. That is, the backward pulse-waiting-times $RS_n$ may be obtained from an expression $RS_n=Rf(v_n)$ (or another expression $RS_n=Rf(v_{n-1})$ or the like)

Alternatively, respective time-gaps between adjacent two forward-timings $T_n$ can be used as parameters roughly corresponding to the speeds of the recording head 10. That is, the pulse-falling-signal outputting part 103 may respectively determine the forward pulse-waiting-times $S_n$ correspondingly to the respective forward-timings $T_n$, based on the respective time-gaps between the forward-timings $T_n$.

For example, the forward pulse-waiting-times $S_n$ may be obtained from an expression $S_n=g(T_n-T_{n-1})$. If a calculating time is taken into consideration, another expression $S_n=g(T_{n-1}-T_{n-2})$ may be used.

Similarly, the pulse-falling-signal outputting part 103 may respectively determine the backward pulse-waiting-times $RS_n$ correspondingly to the respective backward-timings $RT_n$, based on respective time-gaps between the backward-timings $RT_n$.

For example, the backward pulse-waiting-times $RS_n$ may be obtained from an expression $RS_n=Rg(RT_n-RT_{n-1})$. If a calculating time is taken into consideration, another expression $RS_n=Rg(RT_{n-1}-RT_{n-2})$ may be used.

Alternatively, changes (transition): of respective time-gaps between adjacent two forward-timings $T_n$ can be used. That is, the pulse-falling-signal outputting part 103 may respectively determine the forward pulse-waiting-times $S_n$ correspondingly to the respective forward-timings $T_n$, based on the changes of the respective time-gaps between the forward-timings $T_n$.

For example, the forward pulse-waiting-times $S_n$ may be obtained from an expression $S_n=h((T_n-T_{n-1})-(T_{n-1}-T_{n-2}))$. If a calculating time is taken into consideration, another expression $S_n=h((T_{n-1}-T_{n-2})-(T_{n-2}-T_{n-3}))$ may be used.

Similarly, the pulse-falling-signal outputting part 103 may respectively determine the backward pulse-waiting-times $RS_n$ correspondingly to the respective backward-timings $RT_n$, based on changes of respective time-gaps between the backward-timings $RT_n$.

For example, the backward pulse-waiting-times $RS_n$ may be obtained from an expression $R_n=Rh((RT_n-RT_{n-1})-(RT_{n-1}-RT_{n-2}))$. If a calculating time is taken into consideration, another expression $R_n=Rh((RT_{n-1}-RT_{n-2})-(RT_{n-2}-RT_{n-3}))$ may be used.

Alternatively, the pulse-falling-signal outputting part 103 may respectively determine the forward pulse-waiting-times $S_n$ based on the previous forward pulse-waiting-times $S_{n-1}$ that has been obtained at the previous forward-timings $T_{n-1}$. That is, the forward pulse-waiting-times $S_n$ may be obtained from an expression $S_n=i(S_{n-1})$. In the case, for example:

$$i(S_{n-1}) = \begin{cases} S_{n-1}-\alpha & \text{(when accelerated),} \\ S_{n-1} & \text{(when constant), or} \\ S_{n-1}+\alpha & \text{(when decelerated).} \end{cases}$$

In addition, in the case, the initial value or $S_0$ may be defined separately.

Similarly, the pulse-falling-signal outputting part 103 may respectively determine the backward pulse-waiting-times $RS_n$ based on the previous backward pulse-waiting-times $RS_{n-1}$ that has been obtained at the previous backward-timings $RT_{n-1}$. That is, the backward pulse-waiting-times $RS_n$ may be obtained from an expression $RS_n=Ri(RS_{n-1})$. In the case, for example:

$$Ri(RS_{n-1}) = \begin{cases} RS_{n-1}-\beta & \text{(when accelerated),} \\ RS_{n-1} & \text{(when constant), or} \\ RS_{n-1}+\beta & \text{(when decelerated).} \end{cases}$$

In addition, in the case, the initial value or $RS_0$ may be defined separately.

For each of the above various functions (expressions) for obtaining the forward pulse-waiting-times $S_n$ or the backward pulse-waiting-times $RS_n$, a plurality of expressions may be provided to respectively correspond to a plurality of categories of information of environment in which the ink-jetting printer 1 (liquid jetting apparatus) is installed.

For example, with respect to the above function $f(v_n)$, a function $f_1(v_n)$ to be used at a relatively high temperature, a function $f_2(v_n)$ to be used at a relatively intermediate temperature and a function $f_3(v_n)$ to be used at a relatively low temperature may be provided. Then, dependently on the present information of the environment in which the ink-jetting printer 1 is installed, one of the three functions may be used for determining the forward pulse-waiting-times $S_n$.

Alternatively, the forward pulse-waiting-times $S_n$ obtained by the function $f(v_n)$ may be inputted into an additional function that depends on the information of the environment. Then, values outputted from the additional function may be used as the final forward pulse-waiting-times $S_n$.

The information of the environment may be information of environment temperature, information of environment humidity, and so on. The information may be obtained from known various environment-information sensors 301 or the like (see FIG. 3).

The moving speed of the recording head 10 may be affected by the weight of the ink remaining in the ink cartridge mounted on the recording head 10. Thus, the forward pulse-waiting-times $S_n$ may be amended based on information of an amount of the ink (liquid) remaining in the recording head 10.

For example, the forward pulse-waiting-times $S_n$ obtained by the function $f(v_n)$ may be inputted into an additional function that depends on the information of an amount of the ink remaining in the recording head 10. Then, values outputted from the additional function may be used as the final forward pulse-waiting-times $S_n$.

For example, the information of an amount of the ink remaining in the recording head 10 may be obtained from the ink cartridge mounted on the recording head 10. The information may be obtained by known various ink-remaining-amount sensors 302 (see FIG. 3). Alternatively, the information may be obtained by a method of calculating an amount of the remaining ink based on the number of jetted dots of the ink.

Alternatively, for each of the above various functions (expressions) for obtaining the forward pulse-waiting-times $S_n$ or the backward pulse-waiting-times $RS_n$ a plurality of functions (expressions) may be provided to respectively correspond to a plurality of categories of the information of an amount of the ink remaining in the recording head 10. Then, dependently on the present information of an amount of the ink remaining in the recording head 10, one of the plurality of functions may be used.

The calculation of the forward pulse-waiting-times $S_n$ or the backward pulse-waiting-times $RS_n$ by using the above functions is conducted in such a manner that a plurality of drops of the ink (liquid) can be jetted at respective intermediate timings between adjacent two forward-timings $T_n$, and that a plurality of drops of the ink can be jetted at respective intermediate timings between adjacent two backward-timings $RT_n$.

Alternatively, the calculation of the forward pulse-waiting-times $S_n$ or the backward pulse-waiting-times $RS_n$ is conducted in such a manner that a plurality of drops of the ink can be jetted at respective intermediate positions between adjacent two passage-positions of the recording head 10, the respective passage-positions corresponding to the respective forward-timings $T_n$, and that a plurality of drops of the ink can be jetted at respective intermediate positions between adjacent two passage-positions of the recording head 10, the respective passage-positions corresponding to the respective backward-timings $RT_n$.

In short, in the present invention, the purpose of obtaining the forward pulse-waiting-times $S_n$ or the backward pulse-waiting-times $RS_n$ is to cause the positions on the recording paper 8, which are reached by the drops of the ink jetted by the forward pulse-waves PW1 while the recording head 10 is moved forward, and the positions on the recording paper 8, which are reached by the drops of the ink jetted by the backward pulse-waves PW2 while the recording head 10 is moved backward, to substantially coincide with each other in the main scanning direction of the recording head 10, and thus to prevent generation of a Bi-D gap as much as possible.

Figure 10:
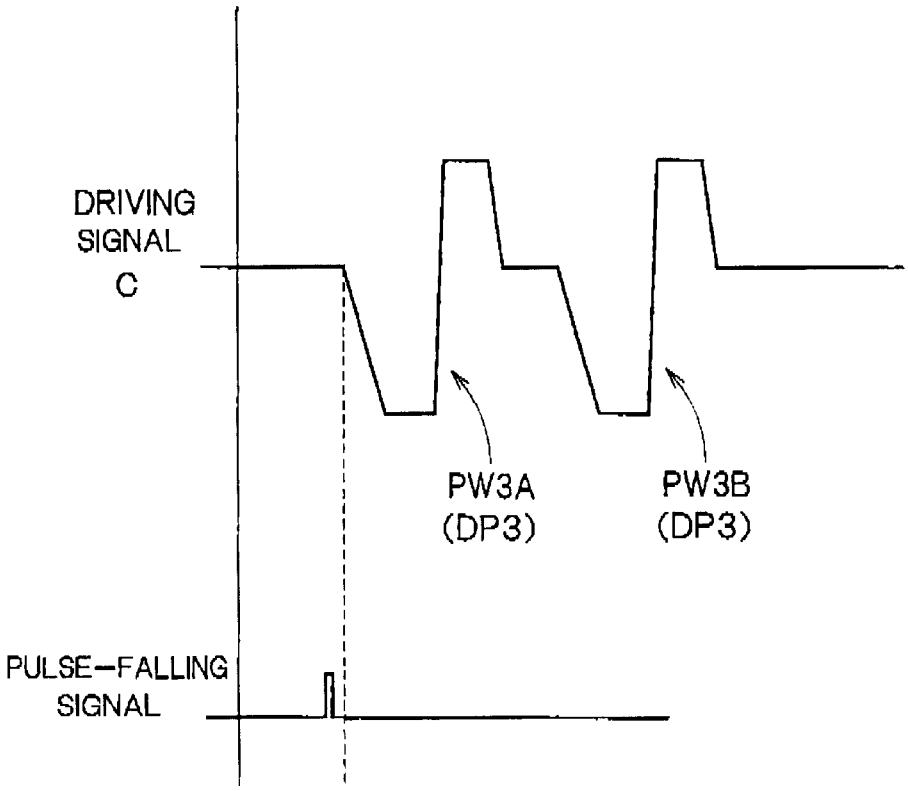
FIG. 10 is a diagram of another example of a forward driving signal.

Then, FIG. 10 shows another example of a forward driving signal. As shown in FIG. 10, in the driving signal C, each pulse-wave PW1 in the driving signal A is replaced with two sequential pulse-waves PW3A and PW3B. In the case, the two pulse-waves PW3A and PW3B have the same waveform, and each of them is a small-dot driving pulse DP3 for jetting a small drop of the ink from the nozzle 13. Thus, if two small drops of the ink are sequentially jetted from the nozzle 13 by the two pulse-waves PW3A and PW3B, a larger dot may be formed on the recording paper 8.

Thus, even if a waveform of any pulse-wave is changed, substantially the same effect as the above embodiment may be achieved.

Figure 11:
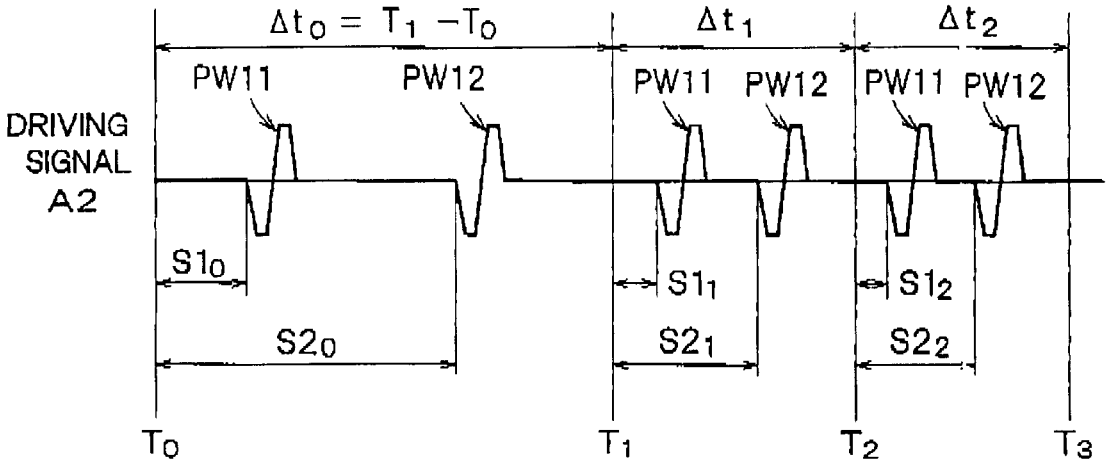
FIG. 11 is a diagram of another preferable example of a forward driving signal.

Next, FIG. 11 shows another preferable example of a forward jetting-driving signal. The jetting-driving signal A2 shown in FIG. 11 corresponds to the forward-moving state of the recording head 10 shown in FIGS. 5A and 5B, and includes; a plurality of forward first pulse-waves PW11 that respectively fall down when respective first forward pulse-waiting-times $S1_n$ have passed since respective forward-timings $T_n$, which are described below; and a plurality of forward second pulse-waves PW12 that respectively fall down when respective second forward pulse-waiting-times $S2_n$ have passed since the respective forward-timings $T_n$. In the driving signal A2, each of the forward first pulse-waves PW11 and the forward second pulse-waves PW12 is the above small-dot driving pulse DP1 for jetting a small drop of the ink from the nozzle 13 (see FIG. 6).

The first forward pulse-waiting-times $S1_n$ are respectively defined correspondingly to the respective forward-timings $T_n$. In addition, the second forward pulse-waiting-times $S2_n$ are also respectively defined correspondingly to the respective forward-timings $T_n$.

When the driving-pulse DP1 is supplied to the piezoelectric vibrating member 15, a drop of the ink, whose volume corresponds to a small dot, is jetted from the nozzle 13.

In detail, when the first discharging element P1 is supplied to the piezoelectric vibrating member 15, the piezoelectric vibrating member 15 is discharged from the middle electric potential VM. Then, the corresponding pressure chamber 16 is caused to expand from a standard volume thereof to a maximum volume thereof. Then, by the first charging element P3, the pressure chamber 16 is caused to rapidly contract to a minimum volume thereof. Such a contracting state of the pressure chamber 16 is maintained while the second holding element P4 is supplied to the piezoelectric vibrating member 15. The rapid contraction and the keeping of the contracting state of the pressure chamber 16 raise a pressure of the ink in the pressure chamber 16 so rapidly that a small drop of the ink is jetted from the nozzle 13. Then, by the second discharging element P5, the pressure chamber 16 is caused to expand back to an original state thereof in order to settle down a vibration of a meniscus of the ink at the nozzle 13 within a short time.

Figure 12:
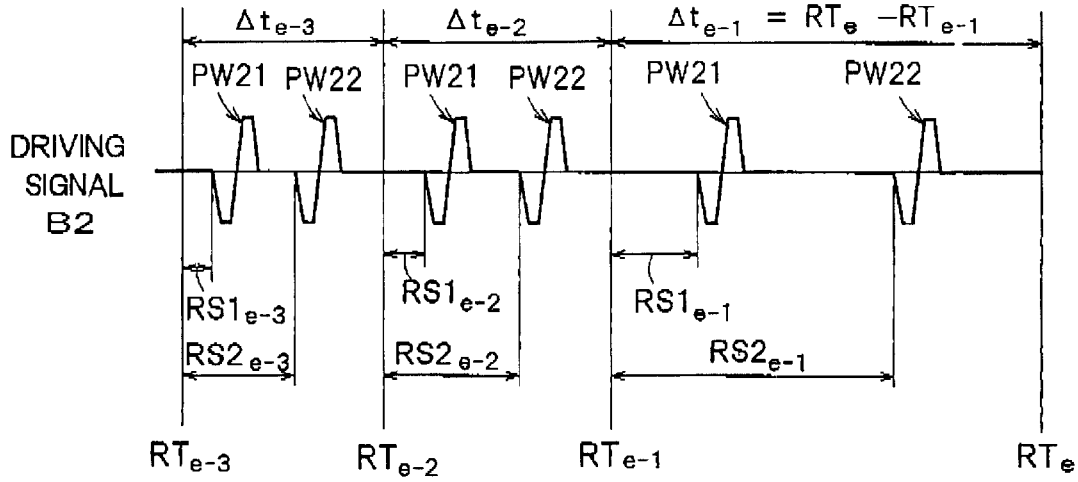
FIG. 12 is a diagram of another preferable example of a backward driving signal.

Then, a preferable example of a backward jetting-driving signal is shown in FIG. 12. The jetting-driving signal B2 shown in FIG. 12 corresponds to the backward-moving state of the recording head 10 shown in FIGS. 7A and 7B, and includes: a plurality of backward first pulse-waves PW21 that respectively fall down when respective first backward pulse-waiting-times $RS1_n$ have passed since respective backward-timings $RT_n$, which are described below; and a plurality of backward second pulse-waves PW22 that respectively fall down when respective second backward pulse-waiting-times $RS2_n$ have passed since the respective backward-timings $RT_n$. In the driving signal B2, the backward first pulse-wave PW21 and the backward second pulse-wave PW22 have the same waveform as the forward first pulse-wave PW1 and the forward second pulse-wave PW12 in the driving signal A2, and each of them is the small-dot driving pulse DP1 for jetting a small drop of the ink from the nozzle 13.

The first backward pulse-waiting-times $RS1_n$ are respectively defined correspondingly to the respective backward-timings $RT_n$. In addition, the second backward pulse-waiting-times $RS2_n$ are also respectively defined correspondingly to the respective backward-timings $RT_n$.

In addition, in the case, the driving-signal generating circuit 30 also has a pulse-falling-signal outputting part 103 that outputs a forward first pulse-falling signal when the corresponding first forward pulse-waiting-time $S1_n$ has passed after each forward timing signal and that outputs a forward second pulse-falling signal when the corresponding second forward pulse-waiting-time $S2_n$ has passed after each forward timing signal, during a forward movement of the recording head 10, based on the first forward pulse-waiting-times $S1_n$ and the second forward pulse-waiting-times $S2_n$ that are respectively defined correspondingly to the respective forward timing signals.

In addition, the pulse-falling-signal outputting part 103 is adapted to output a backward first pulse-falling signal when the corresponding first backward pulse-waiting-time $RS1_n$ has passed after each backward timing signal and a backward second pulse-falling signal when the corresponding second backward pulse-waiting-time $RS2_n$ has passed after each backward timing signal, during a backward movement of the recording head 10, based on the first backward pulse-waiting-times $RS1_n$ and the second backward pulse-waiting-times $RS2_n$ that are respectively defined correspondingly to the respective backward timing signals.

The pulse-falling-signal outputting part 103 of this embodiment is adapted to respectively define the first forward pulse-waiting-times $S1_n$ and the second forward pulse-waiting-times $S2_n$ correspondingly to the respective forward-timings, dependently on a forward-moving state of the recording head 10 by means of the pulse motor 7 (reciprocating mechanism). Concretely, in this embodiment, the first forward pulse-waiting-times $S1_n$ and the second forward pulse-waiting-times $S2_n$ are respectively determined correspondingly to the respective forward-timings, based on a predetermined acceleration-deceleration curve, according to which the recording head 10 is to be moved forward, stored (set) in the ROM 27 in advance (see FIG. 5A). The acceleration-deceleration curve may be set and/or stored as a data table, a function or the like.

Similarly, the pulse-falling-signal outputting part 103 of this embodiment is adapted to respectively define the first backward pulse-waiting-times $RS1_n$ and the second backward pulse-waiting-times $RS2_n$ correspondingly to the respective backward-timings, dependently on a backward-moving state of the recording head 10 by means of the pulse motor 7 (reciprocating mechanism). Concretely, in this embodiment, the first backward pulse-waiting-times $RS1_n$ and the second backward pulse-waiting-times $RS2_n$ are respectively determined correspondingly to the respective backward-timings, based on a predetermined acceleration-deceleration curve, according to which the recording head 10 is to be moved backward, stored (set) in the ROM 27 in advance (see FIG. 7A).

The timing-signal outputting part 101 and the pulse-falling-signal outputting part 103 are connected to a main part 105 (forward-driving-signal generator and backward-driving-signal generator).

The main part 105 is adapted to generate the driving signal A2 in which the plurality of forward first pulse-waves PW11 appear synchronously with outputting timings of the respective forward first pulse-falling signals and the plurality of forward second pulse-waves PW12 appear synchronously with outputting timings of the respective forward second pulse-falling signals, after the respective forward-timings $T_n$ (outputting timings of the timing signals), during the forward movement of the recording head 10 (see FIG. 11).

On the other hand, during the backward movement of the recording head 10, the main part 105 is adapted to generate the driving signal B2 in which the plurality of backward first pulse-waves PW21 appear synchronously with outputting timings of the respective backward first pulse-falling signals and the plurality of backward second pulse-waves PW22 appear synchronously with outputting timings of the respective backward second pulse-falling signals, after the respective backward-timings $RT_n$ (outputting timings of the timing signals) (see FIG. 12).

Then, if a bit of the printing data at a forward-timing is "1", the switching circuit 45 (driving-pulse generator) is closed (connected) from the forward-timing to the next forward-timing.

Thus, based on the dot-pattern data, two driving pulses DP1 are supplied to the corresponding piezoelectric vibrating member 15. As a result, two small-volume drops of the ink are jetted from the nozzle 13. Thus, a combined dot is formed on the recording paper 8.

Similarly, if a bit of the printing data at a backward-timing is "1", the switching circuit 45 (driving-pulse generator) is closed (connected) from the backward-timing to the next backward-timing.

Thus, based on the dot-pattern data, two driving pulses DP1 are supplied to the corresponding piezoelectric vibrating member 15. As a result, two small-volume drops of the ink are jetted from the nozzle 13. Thus, a combined dot is formed on the recording paper 8.

Figure 13:
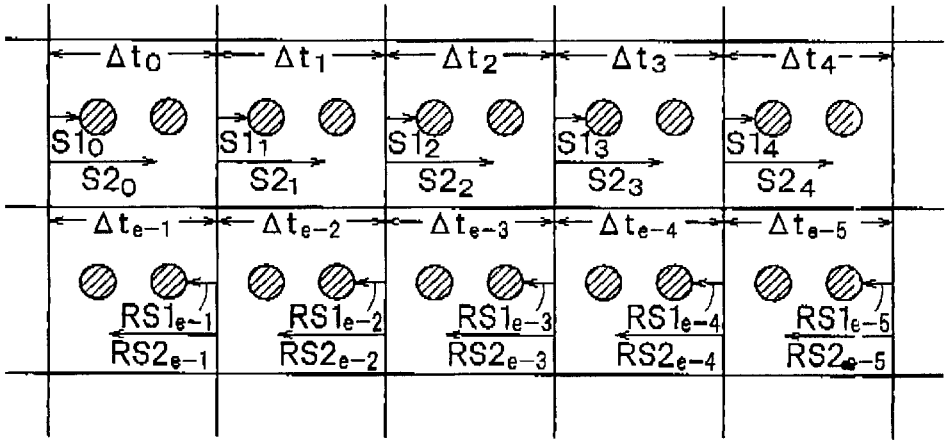
FIG. 13 is a view showing respective positions which a plurality of drops of ink reach during a forward movement and respective positions which a plurality of drops of ink reach during a backward movement, according to another embodiment of the invention.

Then, as shown in FIG. 13, positions on the recording paper 8, which the jetted drops of the ink reach in, the main scanning direction while the recording head 10 is moved, forward, substantially coincide with positions on the recording paper 8, which the jetted drops of the ink reach in the main scanning direction while the recording head 10 is moved backward. Thus, the positions that the jetted drops of the ink reach may be aligned in the sub-scanning direction, so that much higher printing accuracy can be achieved.

According to the above driving signals, even if the moving speed of the recording head 10 is accelerated or decelerated so that positions which the jetted drops of the ink reach may not be aligned, generation of a Bi-D gap can be prevented. In addition, as shown in FIG. 13, positions that are reached by two drops of the ink can be adjusted to be always constant in each pixel (image unit). Thus, much higher printing accuracy can be achieved with much less uneven or irregular printing portions.

Especially, according to the embodiment, the forward jetting-driving signal is generated correspondingly to the forward-moving state of the recording head 10 and the backward jetting-driving signal is generated correspondingly to the backward-moving state of the recording head 10. Thus, even if the forward-moving state of the recording head 10 and the backward-moving state of the recording head 10 include the same or different acceleration and/or deceleration states, generation of a Bi-D gap can be effectively prevented.

In the above embodiment, the pulse-falling-signal outputting part 103 is adapted to respectively determine the first forward pulse-waiting-times $S1_n$, the second forward pulse-waiting-times $S2_n$, the first backward pulse-waiting-times $RS1_n$ and the second backward pulse-waiting-times $RS2_n$, correspondingly to the respective forward-timings and the respective backward-timings, based on the acceleration-deceleration curve for the recording head 10 to be moved forward and the acceleration-deceleration curve for the recording head 10 to be moved backward, which are stored (set) in the ROM 27 in advance.

However, the pulse-falling-signal outputting part 103 may respectively determine the first forward pulse-waiting-times $S1_n$ and the second forward pulse-waiting-times $S2_n$ correspondingly to the respective forward-timings $T_n$, based on respective speeds $v_n$ of the recording head 10 obtained at the respective forward-timings $T_n$. That is, the first forward pulse-waiting-times $S1_n$ and the second forward pulse-waiting-times $S2_n$ may be obtained from expressions $S1_n=f1(v_n)$ and $S2_n=f2(v_n)$. In order to obtain the speed $v_n$ of the recording head 10, a differentiator, which may be mounted on the encoder 102, may be used. In addition, any other known way may be adopted to obtain the speed $v_n$ of the recording head 10. If calculating times are taken into consideration; other expressions $S1_n=f1(v_{n-1})$ and $S2_n=f2(v_{n-1})$ or the like may be used.

Similarly, the pulse-falling-signal outputting part 103 may respectively determine the first backward pulse-waiting-times $RS1_n$ and the second backward pulse-waiting-times $RS2_n$ correspondingly to the respective backward-timings $RT_n$, based on respective speeds $v_n$ of the recording head 10 obtained at the respective backward-timings $RT_n$. That is, the first backward pulse-waiting-times $RS1_n$ and the second backward pulse-waiting-times $RS2_n$ may be obtained from expressions $RS1_n=Rf1(v_n)$ and $RS2_n=Rf2(v_n)$ (or other expressions $RS1_n=Rf1(v_{n-1})$ and $RS2_n=Rf2(v_{n-1})$ or the like).

Alternatively, respective time-gaps between adjacent two forward-timings $T_n$ can be used as parameters roughly corresponding to the speeds of the recording head 10. That is, the pulse-falling-signal outputting part 103 may respectively determine the first forward pulse-waiting-times $S1_n$ and the second forward pulse-waiting-times $S2_n$ correspondingly to the respective forward-timings $T_n$, based on the respective time-gaps between the forward-timings $T_n$.

For example, the first forward pulse-waiting-times $S1_n$ may be obtained from an expression $S1_n=g1(T_n-T_{n-1})$, and the second forward pulse-waiting-times $S2_n$ may be obtained from an expression $S2_n=g2(T_n-T_{n-1})$. If calculating times are taken into consideration, other expressions $S1_n=g1(T_{n-1}-T_{n-2})$ and $S2_n=g2(T_{n-1}-T_{n-2})$ may be used.

Similarly, the pulse-falling-signal outputting part 103 may respectively determine the first backward pulse-waiting-times $RS1_n$ and the second backward pulse-waiting-times $RS2_n$ correspondingly to the respective backward-timings $RT_n$, based on respective time-gaps between the backward-timings $RT_n$.

For example, the first backward pulse-waiting-times $RS1_n$ may be obtained from an expression $RS1_n=Rg1(RT_n-RT_{n-1})$, and the second backward pulse-waiting-times $RS2_n$ may be obtained from an expression $RS2_n=Rg2(RT_n-RT_{n-1})$. If calculating times are taken into consideration, other expressions $RS1_n=Rg1(RT_{n-1}-RT_{n-2})$ and $RS2_n=Rg2(RT_{n-1}-RT_{n-2})$ may be used.

Alternatively, changes (transition) of respective time-gaps between adjacent two forward-timings $T_n$ can be used. That is, the pulse-falling-signal outputting part 103 may respectively determine the first forward pulse-waiting-times $S1_n$ and the second forward pulse-waiting-times $S2_n$ correspondingly to the respective forward-timings $T_n$, based on the changes of the respective time-gaps between the forward-timings $T_n$.

For example, the first forward pulse-waiting-times $S1_n$ may be obtained from an expression $S1_n=h1((T_n-T_{n-1})-(T_{n-1}-T_{n-2}))$, and the second forward pulse-waiting-times $S2_n$ may be obtained from an expression $S2_n=h2((T_n-T_{n-1})-(T_{n-1}-T_{n-2}))$. If calculating times are taken into consideration, other expressions $S1_n=h1((T_{n-1}=T_{n-2})-(T_{n-2}-T_{n-3}))$ and $S2_n=h2((T_{n-1}-T_{n-2})-(T_{n-2}-T_{n-3}))$ may be used.

Similarly, the pulse-falling-signal outputting part 103 may respectively determine the first backward pulse-waiting-times $RS1_n$ and the second backward pulse-waiting-times $RS2_n$ correspondingly to the respective backward-timings $RT_n$, based on changes of respective time-gaps between the backward-timings $RT_n$.

For example, the first backward pulse-waiting-times $RS1_n$ may be obtained from an expression $RS1_n=Rh1((RT_n-RT_{n-1})-(RT_{n-1}-RT_{n-2}))$, and the second backward pulse-waiting-times $RS2_n$ may be obtained from an expression $RS2_n=Rh2((RT_n-RT_{n-1})-(RT_{n-1}-RT_{n-2}))$. If calculating times are taken into consideration, other expressions $RS1_n=Rh1((RT_{n-1}-RT_{n-2})-(RT_{n-2}-RT_{n-3}))$ and $RS2_n=Rh2((RT_{n-1}-RT_{n-2})-(RT_{n-2}-RT_{n-3}))$ may be used.

Alternatively, the pulse-falling-signal outputting part 103 may respectively determine the first forward pulse-waiting-times $S1_n$ and the second forward pulse-waiting-times $S2_n$ based on the previous first forward pulse-waiting-times $S1_{n-1}$ and the previous second forward pulse-waiting-times $S2_{n-1}$ that have been obtained at the previous forward-timings $T_{n-1}$. That is, the first forward pulse-waiting-times $S1_n$ may be obtained from an expression $S1_n=i1(S1_{n-1})$, and the second forward pulse-waiting-times $S2_n$ may be obtained from an expression $S2_n=i2(S2_{n-1})$. In the case, for example:

$$i1(S1_{n-1}) = \begin{cases} S1_{n-1}-\alpha & \text{(when accelerated)}, \\ S1_{n-1} & \text{(when constant), or} \\ S1_{n-1}+\alpha & \text{(when decelerated)}, \end{cases} \text{ and}$$

$$i2(S2_{n-1}) = \begin{cases} S2_{n-1}-\alpha & \text{(when accelerated)}, \\ S2_{n-1} & \text{(when constant), or} \\ S2_{n-1}+\alpha & \text{(when decelerated)}. \end{cases}$$

In addition, in the case, the initial values or $S1_0$ and $S2_0$ may be defined separately.

Similarly, the pulse-falling-signal outputting part 103 may respectively determine the first backward pulse-waiting-times $RS1_n$ and the second backward pulse-waiting-times $RS2_n$ based on the previous first backward pulse-waiting-times $RS1_{n-1}$ and the previous second backward pulse-waiting-times $RS2_{n-1}$ that have been obtained at the previous backward-timings $RT_{n-1}$. That is the first backward pulse-waiting-times $RS1_n$ may be obtained from an expression $RS1_n=Ri1(RS1_{n-1})$, and the second backward pulse-waiting-times $RS2_n$ may be obtained from an expression $RS2_n=Ri2(RS2_{n-1})$. In the case, for example:

$$Ri1(RS1_{n-1}) = \begin{cases} RS1_{n-1} - \beta & \text{(when accelerated)}, \\ RS1_{n-1} & \text{(when constant), or} \\ RS1_{n-1} + \beta & \text{(when decelerated), and} \end{cases}$$

$$Ri2(RS2_{n-1}) = \begin{cases} RS2_{n-1} - \beta & \text{(when accelerated)}, \\ RS2_{n-1} & \text{(when constant), or} \\ RS2_{n-1} + \beta & \text{(when decelerated).} \end{cases}$$

In addition, in the case, the initial values or $RS1_0$ and $RS2_0$ may be defined separately.

For each of the above various functions (expressions) for obtaining the first forward pulse-waiting-times $S1_n$, the second forward pulse-waiting-times $S2_n$, the first backward pulse-waiting-times $RS1_n$ and/or the second backward pulse-waiting-times $RS2_n$, a plurality of expressions may be provided to respectively correspond to a plurality of categories of information of environment in which the ink-jetting printer 1 (liquid jetting apparatus) is installed.

For example, with respect to the above function $f1(v_n)$, a function $f1_1(v_n)$ to be used at a relatively high temperature, a function $f1_2(v_n)$ to be used at a relatively intermediate temperature and a function $f1_3(v_n)$ to be used at a relatively low temperature may be provided. Then, dependently on the present information of the environment in which the ink-jetting printer 1 is installed, one of the three functions may be used for determining the first forward pulse-waiting-times $S1_n$.

Alternatively, the first forward pulse-waiting-times $S1_n$ obtained by the function $f1(v_n)$ may be inputted into an additional function that depends on the information of the environment. Then, values outputted from the additional function may be used as the final first forward pulse-waiting-times $S1_n$.

The information of the environment may, be information of environment temperature, information of environment humidity, and so on. The information may be obtained from known various environment-information sensors 301 or the like (see FIG. 3).

The moving speed of the recording head 10 may be affected by the weight of the ink remaining in the ink cartridge mounted on the recording head 10. Thus, for example, the first forward pulse-waiting-times $S1_n$ may be amended based on information of an amount of the ink (liquid) remaining in the recording head 10.

For example, the first forward pulse-waiting-times $S1_n$ obtained by the function $f1(v_n)$ may be inputted into an additional function that depends on the information of an amount of the ink remaining in the recording head 10. Then, values outputted from the additional function may be used as the final first forward pulse-waiting-times $S1_n$.

For example, the information of an amount of the ink remaining in the recording head 10 may be obtained from the ink cartridge mounted on the recording head 10. The information may be obtained by known various ink-remaining-amount sensors 302 (see FIG. 3). Alternatively, the information may be obtained by a method of calculating an amount of the remaining ink based on the number of jetted dots of the ink.

Alternatively, for each of the above various functions (expressions) for obtaining the first forward pulse-waiting-times $S1_n$, the second forward pulse-waiting-times $S2_n$, the first backward pulse-waiting-times $RS1_n$ and/or the second backward pulse-waiting-times $RS2_n$, a plurality of functions (expressions) may be provided to respectively correspond to a plurality of categories of the information of an amount of the ink remaining in the recording head 10. Then, dependently on the present information of an amount of the ink remaining in the recording head 10, one of the plurality of functions may be used.

The calculation of the first forward pulse-waiting-times $S1_n$, the second forward pulse-waiting-times $S2_n$, the first backward pulse-waiting-times $RS1_n$ and/or the second backward pulse-waiting-times $RS2_n$ by using the above functions is preferably conducted in such a manner that each difference between each first forward pulse-waiting-times $S1_n$ and each second forward pulse-waiting-times $S2_n$ corresponding to each forward-timing is a half of time-gap between the forward-timing and the next forward-timing, and that each difference between each first backward pulse-waiting-times $RS1_n$ and each second backward pulse-waiting-times $RS2_n$ corresponding to each backward-timing is a halt of time-gap between the backward-timing and the next backward-timing.

Alternatively, the calculation of the first forward pulse-waiting-times $S1_n$, the second forward pulse-waiting-times $S2_n$, the first backward pulse-waiting-times $RS1_n$ and/or the second backward pulse-waiting-times $RS2_n$ is preferably conducted in such a manner that a plurality of drops of the ink can be jetted at predetermined positions symmetric with respect to respective intermediate positions between adjacent two passage-positions of the recording head 10, the respective passage-positions corresponding to the respective forward-timings, and that a plurality of drops of the ink can be jetted at predetermined positions symmetric with respect to respective intermediate positions between adjacent two passage-positions of the recording head 10, the respective passage-positions corresponding to the respective backward-timings.

In short, the purpose of obtaining the first forward pulse-waiting-times $S1_n$, the second forward pulse-waiting-times $S2_n$, the first backward pulse-waiting-times $RS1_n$ and/or the second backward pulse-waiting-times $RS2_n$ is: to cause the positions on the recording paper 8, which are reached by the drops of the ink jetted by the forward first pulse-waves PW11 while the recording head 10 is moved forward, and the positions on the recording paper 8, which are reached by the drops of the ink jetted by the backward second pulse-waves PW22 while the recording head 10 is moved backward, to substantially coincide with each other in the main scanning direction of the recording head 10; and to cause the positions on the recording paper 8, which are reached by the drops of the ink jetted by the forward second pulse-waves PW12 while the recording head 10 is moved forward, and the positions on the recording paper 8, which are reached by the drops of the ink jetted by the backward first pulse-waves PW21 while the recording head 10 is moved backward, to substantially coincide with each other in the main scanning direction of the recording head 10; and thus to prevent generation of a Bi-D gap as much as possible. In addition, the purpose is to cause the distance (gap) between the positions on the recording paper 8 which are reached by the drops of the ink jetted by the forward first pulse-waves PW11 and the positions on the recording paper 8 which are reached by the drops of the ink jetted by the forward second pulse-waves PW12 and the distance (gap) between the positions on the recording paper 8 which are reached by the drops of the ink jetted by the backward first pulse-waves PW21 and the positions on the recording paper 8 which are reached by the drops of the ink jetted by the backward second pulse-waves PW22 to be common in respective pixels (image units), that is, to completely adjust (align) the positions on the recording paper 8 which are reached by the jetted drops of the ink in the respective pixels, to achieve much higher recording quality (see FIG. 13).

Figure 14:
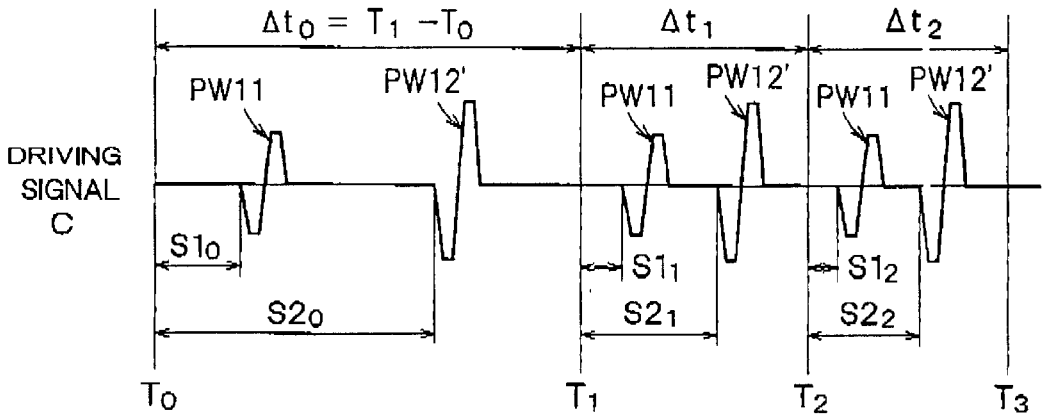
FIG. 14 is a diagram of another preferable example of a forward driving signal.

Next, FIG. 14 shows another example of a forward jetting-driving signal. The jetting-driving signal C shown in FIG. 14 corresponds to the forward-moving state of the recording head 10 shown in FIGS. 5A and 5B, and includes: a plurality of forward first pulse-waves PW11 that respectively fall down when respective first forward pulse-waiting-times $S1_n$ have passed since respective forward-timings $T_n$; and a plurality of forward middle pulse-waves PW12' that respectively fall down when respective second forward pulse-waiting-times $S2_n$ have passed since the respective forward-timings $T_n$. That is, in the driving signal C, each of the forward second pulse-waves PW12 in the driving signal A2 is replaced with each of the forward middle pulse-waves PW12'.

In the driving signal C, each of the forward first pulse-waves PW11 is the above small-dot driving pulse DP1 for jetting a small drop of the ink from the nozzle 13. In addition, each of the forward middle pulse-waves PW12' is a middle-dot driving pulse DP2 for jetting a middle drop of the ink from the nozzle 13.

Figure 15:
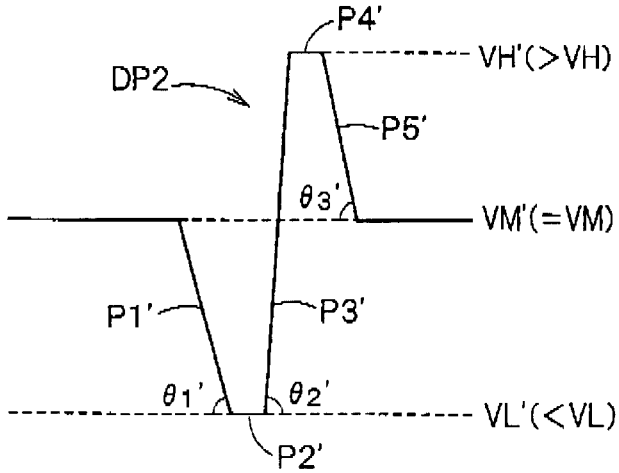
FIG. 15 is a diagram for explaining a driving pulse for jetting a drop of ink forming a middle dot.

As shown in FIG. 15, the driving pulse DP2 includes: a first discharging element P1' falling from a middle electric potential VM' to a lowest electric potential VL' at an incline θ1', a first holding element P2' maintaining the lowest electric potential VL' for a very short time, a first charging element P3' rising from the lowest electric potential VL' to a highest electric potential VH' at a steep incline θ2' within a very short time, a second holding element P4' maintaining the highest electric potential VH' for a time, and a second discharging element P5' falling from the highest electric potential VH' to the middle electric potential VM' at an incline θ3'. (it the piezoelectric vibrating member is longitudinal-vibrating mode, the above waveform is opposite with respect to positive and negative.)

Herein, VL'<VL and VH'>VH. Thus, when the driving-pulse DP2 is supplied to the piezoelectric vibrating member 15, a drop of the ink, whose volume corresponds to a middle dot, is jetted from the nozzle 13. In addition, even if VL'=VL, if VH'−VL'>VH−VL, a drop of the ink, whose volume corresponds to a middle dot, may be similarly jetted from the nozzle 13.

In detail, when the first discharging element P1' is supplied to the piezoelectric vibrating member 15, the piezoelectric vibrating member 15 is discharged from the middle electric potential VM'. Then, the corresponding pressure chamber 16 is caused to expand from a standard volume thereof to a maximum volume thereof. Then, by the first charging element P3', the pressure chamber 16 is caused to rapidly contract to a minimum volume thereof. Such a contracting state of the pressure chamber 16 is maintained while the second holding element P4' is supplied to the piezoelectric vibrating member 15. The rapid contraction and the keeping of the contracting state of the pressure chamber 16 raise a pressure of the ink in the pressure chamber 16 so rapidly that a middle drop of the ink is jetted from the nozzle 13. Then, by the second discharging element P5', the pressure chamber 16 is caused to expand back to an original state thereof in order to settle down a vibration of a meniscus of the ink at the nozzle 13 within a short time.

Other features of the driving signal C are substantially the same as those of the driving signal A2.

Figure 16:
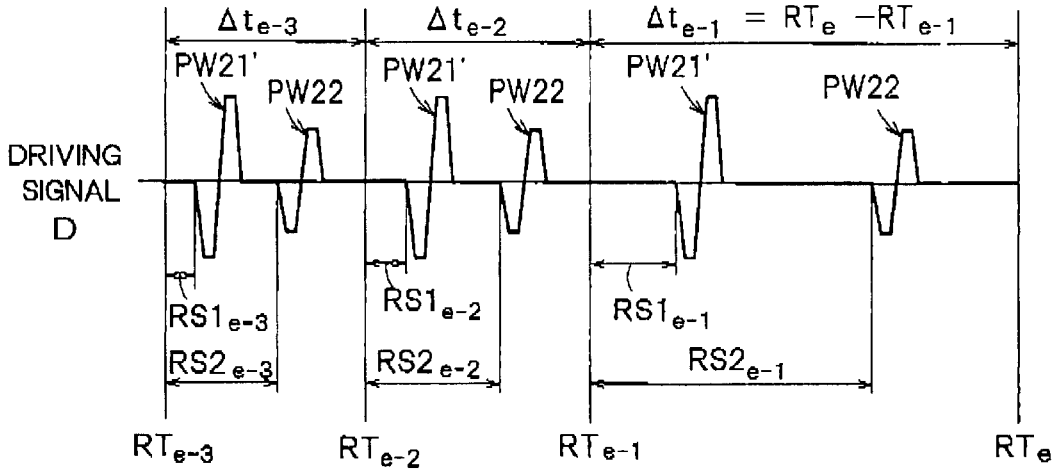
FIG. 16 is a diagram of another preferable example of a backward driving signal.

Then, a preferable example of a backward jetting-driving signal is Shown in FIG. 16. The jetting-driving signal D shown in FIG. 16 corresponds to the backward-moving state of the recording head 10 shown in FIGS. 7A and 7D, and includes: a plurality of backward middle pulse-waves PW21' that respectively fall down when respective first backward pulse-waiting-times $RS1_n$ have passed since respective backward-timings $RT_n$; and a plurality of backward second pulse-waves PW22 that respectively fall down when respective second backward pulse-waiting-times $RS2_n$ have passed since the respective backward-timings $RT_n$. In the driving signal D, the backward middle pulse-wave PW21' has the same waveform as the forward middle pulse-wave PW12' in the driving signal C, and is the middle-dot driving pulse DP2 for jetting a middle drop of the ink from the nozzle 13. In addition, the backward second pulse-wave PW22 in the driving signal D has the same waveform as the forward first pulse-wave PW11 in the driving signal C, and is the small-dot driving pulse DP1 for jetting a small drop of the ink from the nozzle 13.

Other features of the driving signal D are substantially the same as those of the driving signal B2.

As shown in FIGS. 14 to 16, even if the forward jetting-driving signal and the backward jetting-driving signal have a plurality of pulse-waves whose waveforms are different, substantially the same effect as the above embodiment can be achieved.

In addition, if a plurality of pulse-waves is provided for each pixel (image unit), a level (gradation) recording can be achieved by separately controlling use of each of the plurality of pulse-waves. In order to achieve the level recording, the electric structure of the ink-jetting printer is changed to that shown in FIG. 17.

Figure 17:
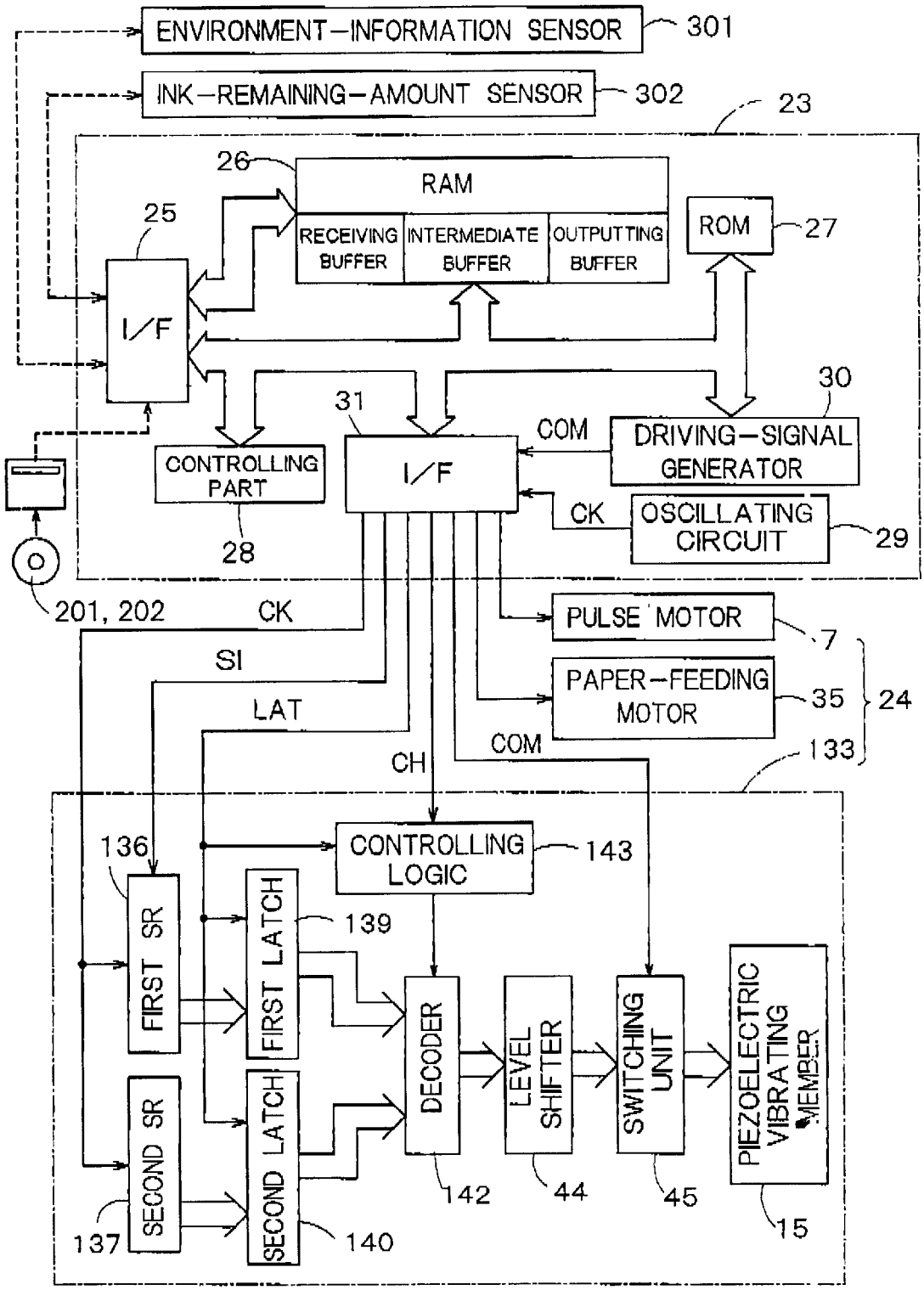
FIG. 17 is a schematic block diagram for explaining another electric structure of the ink-jetting printer.

FIG. 17 is a schematic block diagram showing an electric structure of the ink-jetting printer when a level recording is conducted.

The electric driving system 133 for the recording head 10 shown in FIG. 17 has: a shift-register circuit consisting of a first shift-register 136 and a second shift-register 137; a latch circuit consisting of a first latch-circuit 139 and a second latch-circuit 140; a decoder 142; a controlling logic circuit 143; a level shifter 44; a switching circuit 45; and the piezoelectric vibrating members 15.

Figure 18:
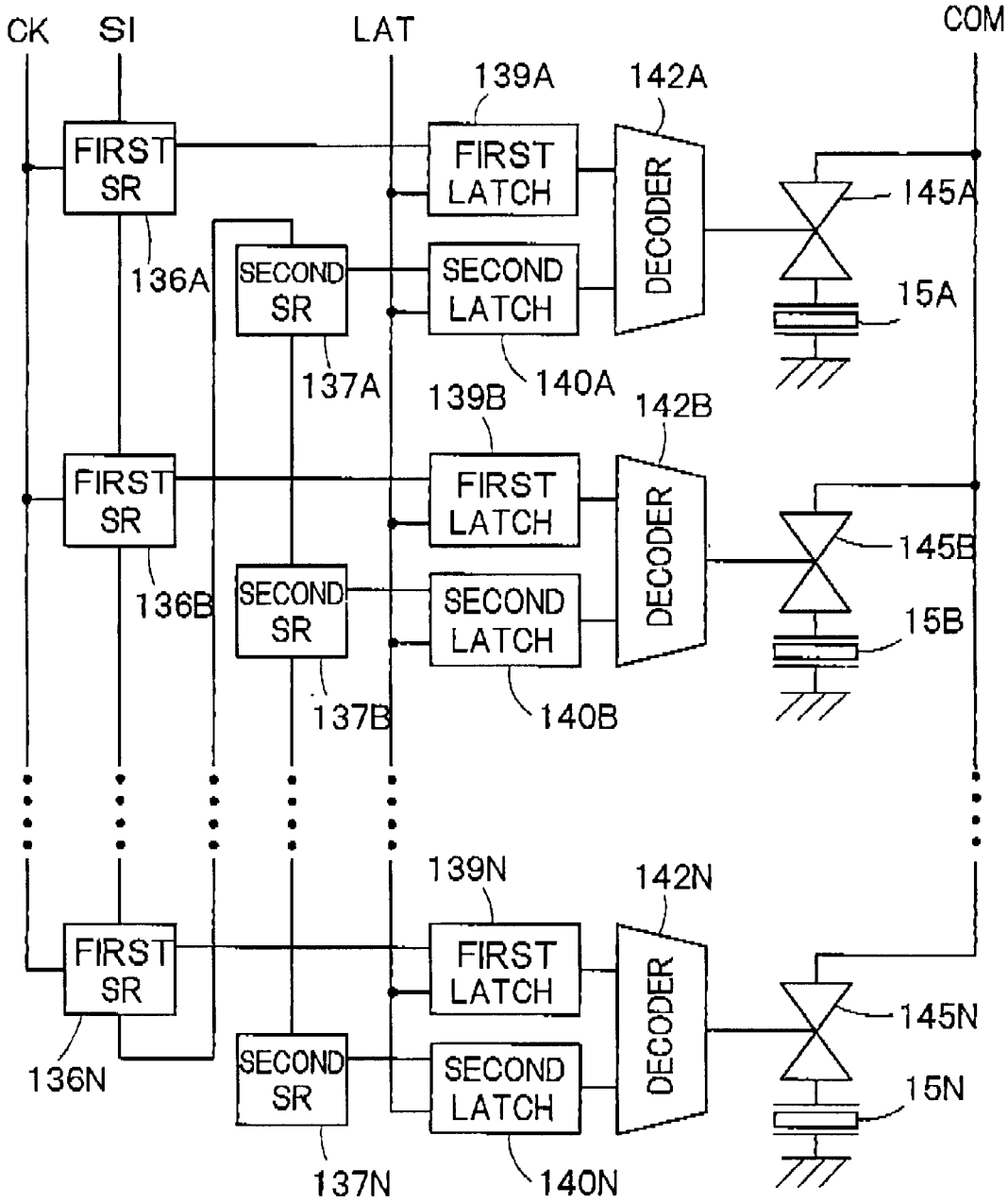
FIG. 18 is a schematic block diagram for explaining another electric driving structure of the recording head.

As shown in FIG. 18, the first shift-register 136 has a plurality of first shift-register devices 136A to 136N, each of which corresponds to each of the nozzles 13 of the recording head 10. Similarly, the second shift-register 137 has a plurality of second shift-register devices 137A to 137N, each of which corresponds to each of the nozzles 13 of the recording head 10. The first latch-circuit 139 has a plurality of first latch-circuit devices 139A to 139N, each of which corresponds to each of the nozzles 13 of the recording head 10. Similarly, the second latch-circuit 140 has a plurality of second latch-circuit devices 140A to 140N, each of which corresponds to each of the nozzles 13 of the recording head 10. The decoder 142 has a plurality of decoder devices 142A to 142N, each of which corresponds to each of the nozzles 13 of the recording head 10. The switching circuit 45 has a plurality of switching circuit devices 45A to 45N, each of which corresponds to each of the nozzles 13 of the recording head 10. Each of the piezoelectric vibrating members 15 corresponds to each of the nozzles 13. Thus, the piezoelectric vibrating members 15 are also designated as piezoelectric vibrating members 15A to 15N.

According to the electric driving system 133, the recording head 10 can jet a drop of the ink, based on the printing data (level data) from the printer controller 23. The printing data (SI) from the printer controller 23 are transmitted in a serial manner to the first shift-register 136 and the second shift-register 137 via the inside I/F 31, synchronously with the clock signal (CK) from the oscillating circuit 29.

The printing data from the printer controller 23 are, for example, level data consisting of 2 bits (dot-pattern date). In details, four levels consisting of no recording, a small dot, a middle dot and a large dot are represented by the two bit data. That is, the level data of no recording may be represented by "00", the level data of the small dot may be represented by "01", the level data of the middle dot may be represented by "10", and the level data of the large dot may be represented by "11".

The printing data are set for each of printing dots, that is, each of the nozzles 13. Then, the lower bits of the printing data for all the nozzles 13 are inputted in the first shift-register devices 136A to 136N, respectively. Similarly, the upper bits of the printing data for all the nozzles 13 are inputted in the second shift-register devices 137A to 137N, respectively.

As shown in FIG. 18, the first shift-register devices 136A to 136N are electrically connected to the first latch-circuit devices 139A to 139N, respectively. Similarly, the second shift-register devices 137A to 137N are electrically connected to the second latch-circuit devices 140A to 140N, respectively. When the latch signals (LAT) from the printer controller 23 are inputted to the first and the second latch-circuit devices 139A to 139N and 140A to 140N, the first latch-circuit devices 139A to 139N latch the lower bits of the printing data, and the second latch-circuit devices 140A to 140N latch the upper bits of the printing data, respectively.

As described above, a circuit unit consisting of the first shift-register 136 and the first latch-circuit 139 may function as a storing circuit. Similarly, a circuit unit consisting of the second shift-register 137 and the second latch-circuit 140 may also function as a storing circuit. That is, these storing circuit can temporarily store the printing data (level data) before inputted to the decoder 142.

The printing data latched in the latch-circuits 139 and 140 are supplied to the decoder 142, that is, the decoder devices 142A to 142N. The decoder devices 142A to 142N decode (translate) the printing data (level data) of the two bits into pulse-selecting data, respectively. Each of the pulse-selecting data has a plurality of bits equal to or more than the level data, each of the plurality of hits corresponds to a pulse-wave forming a part of the driving signal. Then, depending on each of the bits of the pulse selecting data ("0" or "1"), each of the pulse-waves may be supplied or not to the piezoelectric vibrating member 15.

In addition, timing signals from the controlling logic circuit 143 are also inputted to the decoder 142 (decoder devices 142A to 142N). The controlling logic circuit 143 generates the timing signals based on the respective pulse-falling signals for the respective pulse-waves outputted from the driving-signal generating circuit 30. The controlling logic circuit 143 may be arranged in the printer controller 23. In that case too, the controlling logic circuit 143 may function similarly.

The pulse-selecting data translated by the decoder 142 (decoder devices 142A to 142N) are inputted to: the level shifter 44 (respective level shifter devices 44A to 44N) in turn from an uppermost bit thereof to a lowermost bit thereof at respective timings defined by the timing signals. For example, the uppermost bit of the pulse-selecting data is inputted to the level shifter 44 at the first timing of a recording period corresponding to a pixel (image unit), and the second uppermost bit of the pulse-selecting data is inputted to the level shifter 44 at the second timing.

The level shifter 44 is adapted to function as a voltage amplifier. For example, when a bit of the pulse-selecting data is "1", the level shifter 44 raises the datum "1" to a voltage of several decade volts that can drive the switching circuit 45 (respective switching circuit devices 45A to 45N).

The raised datum is applied to the switching circuit 45, which may function as a driving-pulse generator and a main controller. That is, the switching circuit 45 selects and generates one or more driving pulses from the driving signal (COM), based on the pulse-selecting data generated by translating the printing data. The generated one or more driving pulses are supplied to the piezoelectric vibrating member 15. For the purpose, input terminals of the switching circuit devices 45A to 45N are adapted to be supplied the driving signal (COM) from the driving-signal generator 30, and output terminals of the switching circuit devices 45A to 45N are connected to the piezoelectric vibrating members 15A to 15N, respectively.

Each of the switching devices 45A to 45N is controlled by the pulse-selecting data. That is, a switching device of 45A to 45N is closed (connected) when a bit of the pulse-selecting data is "1". Then, the corresponding driving pulse is supplied to the corresponding piezoelectric vibrating member 15. Thus, an electric-potential level of the piezoelectric vibrating member 15 is changed.

On the other hand, when a bit of the pulse-selecting data is "0", a level shifter device of 44A to 44N does not output an electric signal for operating the corresponding switching circuit device of 45A to 45N. Then, the switching circuit device is not connected, so that the corresponding driving pulse (pulse-wave) is not supplied to the corresponding piezoelectric vibrating member 15. While a bit of the pulse-selecting data is "0", the piezoelectric vibrating member 15 holds a previous electric charges. That is, an electric-potential level of the piezoelectric vibrating member 15 is maintained.

For example, in a case wherein the driving signals C and D explained with reference to FIGS. 14 to 16 are used, the decoder 142 generates pulse-selecting data consisting of two bits, based on the small-dot dot-pattern data (level data 01), the middle-dot dot-pattern data (level data 10) and the large-dot dot-pattern data (level data 11), respectively. Each of the two bits corresponds to each of the pulse-waves.

While the recording head 10 is moved forward, the pulse-selecting data generated based on the small-dot dot-pattern data (level data 01) is "10" Similarly, the pulse-selecting data generated based on the middle-dot dot-pattern data (level data 10) is "01", and the pulse-selecting data generated based on the large-dot dot-pattern data (level data 11) is "11".

When the upper bit of the pulse-selecting data is "1", the switching circuit 45 (driving-pulse generator) is closed (connected) during a period corresponding to each forward first pulse-wave PW11. In addition, when the second (lower) bit of the pulse-selecting data is "1", the switching circuit 45 is closed during a period corresponding to each forward middle pulse-wave PW12'.

Thus, based on the small-dot dot-pattern data, only the first driving pulse DP1 is supplied to the corresponding piezoelectric vibrating member 15. Similarly, based on the middle-dot dot-pattern data, only the second driving pulse DP2 is supplied to the corresponding piezoelectric vibrating member 15. In addition, based on the large-dot dot-pattern data, both the first driving pulse DP1 and the second driving pulse DP2 are supplied to the corresponding piezoelectric vibrating member 15 in succession.

As a result, correspondingly to the small-dot dot-pattern data, a small-volume drop of the ink is jetted from the nozzle 13. Thus, a small dot is formed on the recording paper 8. Correspondingly to the middle-dot dot-pattern data, a middle-volume drop of the ink is jetted from the nozzle 13. Thus, a middle dot is formed on the recording paper 8. Correspondingly to the large-dot dot-pattern data, a small-volume drop of the ink and a middle-volume drop of the ink are jetted from the nozzle 13 in succession. Thus, a substantially large dot is formed on the recording paper 8.

While the recording head 10 is moved backward, the pulse-selecting data generated based on the small-dot dot-pattern data (level data 01) is "01". Similarly, the pulse-selecting data generated based on the middle-dot dot-pattern data (level data 10) is "10", and the pulse-selecting data generated based on the large-dot dot-pattern data (level data 11) is "11".

When the upper bit of the pulse-selecting data is "1", the switching circuit 45 (driving-pulse generator) is closed (connected) during a period corresponding to each backward middle pulse-wave PW21'. In addition, when the second (lower) bit of the pulse-selecting data is "1", the switching circuit 45 is closed during a period corresponding to each backward second pulse-wave PW22.

Thus, based on the small-dot dot-pattern data, only the first driving pulse DP1 is supplied to the corresponding piezoelectric vibrating member 15. Similarly, based on the middle-dot dot-pattern data, only the second driving pulse DP2 is supplied to the corresponding piezoelectric vibrating member 15. In addition, based on the large-dot dot-pattern data, both the first driving pulse DP1 and the second driving pulse DP2 are supplied to the corresponding piezoelectric vibrating member 15 in succession.

As a result, correspondingly to the small-dot dot-pattern data, a small-volume drop of the ink is jetted from the nozzle 13. Thus, a small dot is formed on the recording paper 8. Correspondingly to the middle-dot dot-pattern data, a middle-volume drop of the ink is jetted from the nozzle 13. Thus, a middle dot is formed on the recording paper 8. Correspondingly to the large-dot dot-pattern data, a small-volume drop of the ink and a middle-volume drop of the ink are jetted from the nozzle 13 in succession. Thus, a substantially large dot is formed on the recording paper 8.

Then, positions on the recording paper 8, which the small-volume drops of the ink and the middle-volumes drop of the ink reach in the main scanning direction while the recording head 10 is moved forward, substantially coincide with positions on the recording paper 8, which the small-volume drops of the ink and the middle-volumes drop of the ink reach in the main scanning direction while the recording head 10 is moved backward. Thus, the positions that the jetted drops of the ink reach may be aligned in the sub-scanning direction, so that much higher printing accuracy can be achieved.

The above explanation is given for the case wherein each of the forward jetting-driving signal and the backward jetting-driving signal has a plurality of two pulse-waves. However, the feature of this invention is also applicable to cases wherein each of the forward jetting-driving signal and the backward jetting-driving signal has a plurality of three or more pulse-waves.

Figure 19:
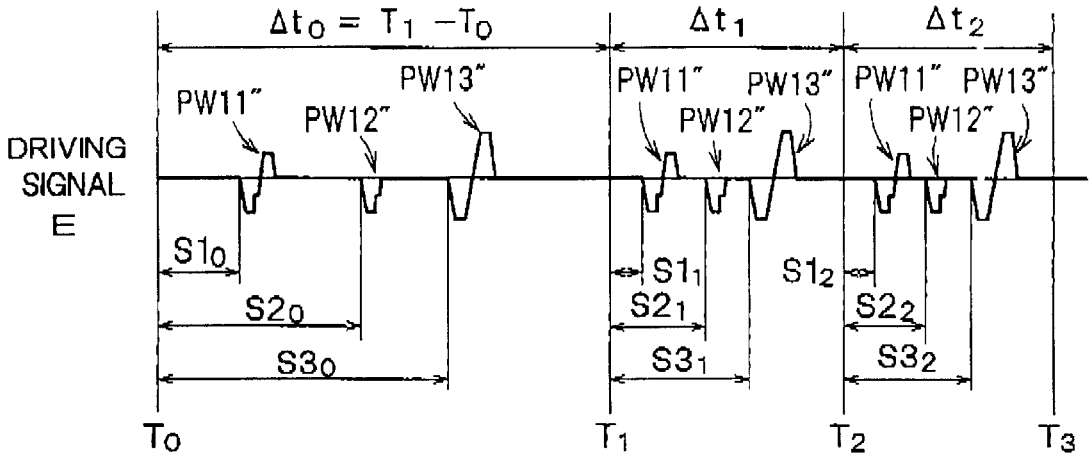
FIG. 19 is a diagram of another preferable example of a forward driving signal.

For example, FIG. 19 shows an example of a forward jetting-driving signal including a plurality of three pulse-waves. The jetting-driving signal E shown in FIG. 19 corresponds to the forward-moving state of the recording head 10 shown in FIGS. 5A and 5B, and includes: a plurality of forward first pulse-waves PW11" that respectively fall down when respective first forward pulse-waiting-times $S1_n$ have passed since respective forward-timings $T_n$; a plurality of forward second pulse-waves PW12" that respectively fall down when respective second forward pulse-waiting-times $S2_n$ have passed since the respective forward-timings $T_n$; and a plurality of forward third pulse-waves PW13" that respectively fall down when respective third forward pulse-waiting-times $S3_n$ have passed since the respective forward-timings $T_n$.

The first forward pulse-waiting-times $S1_n$ are respectively defined correspondingly to the respective forward-timings $T_n$. The second forward pulse-waiting-times $S2_n$ are also respectively defined correspondingly to the respective forward-timings $T_n$, and the third forward pulse-waiting-times $S3_n$ are also respectively defined correspondingly to the respective forward-timings $T_n$.

The details of determination of the first forward pulse-waiting-times $S1_n$, the second forward pulse-waiting-times $S2_n$ and the third forward pulse-waiting-times $S3_n$ are substantially the same as those of determination of the first forward pulse-waiting-times $S1_n$ and the second forward pulse-waiting-times $S2_n$ for the driving signal A2.

In the driving signal E, each of the forward first pulse-waves PW11" is a middle-dot driving pulse DP11' for jetting a middle drop of the ink from the nozzle 13, each of the forward second pulse-waves PW12" is a small-dot driving pulse DP12' for jetting a small drop of the ink from the nozzle 13, and each of the forward third pulse-waves PW13" is a large-dot driving pulse DP13' for jetting a large drop of the ink from the nozzle 13.

Figure 20:
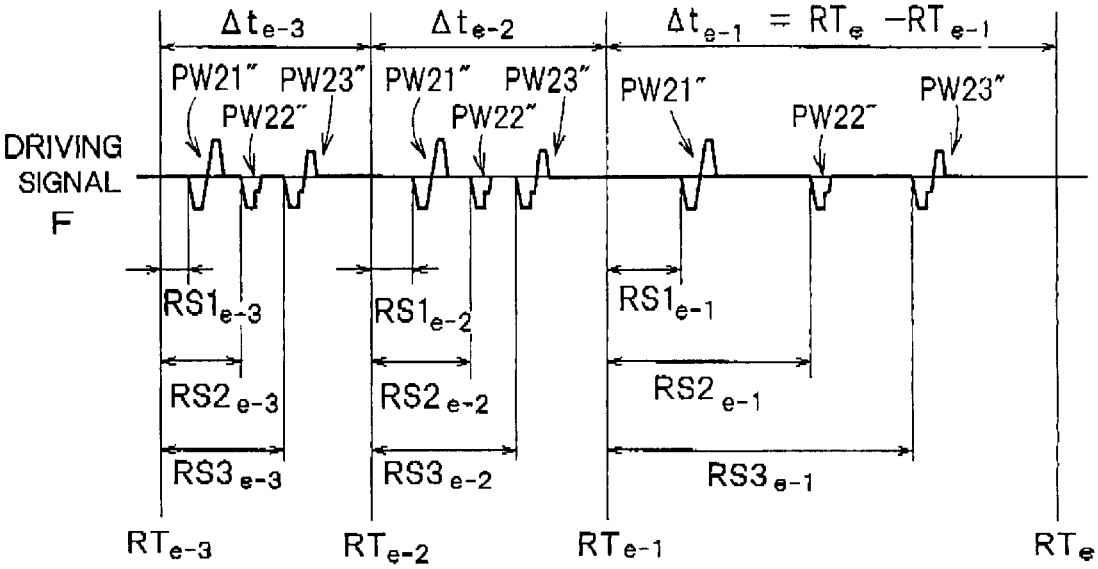
FIG. 20 is a diagram of another preferable example of a backward driving signal.
Figure 21A:
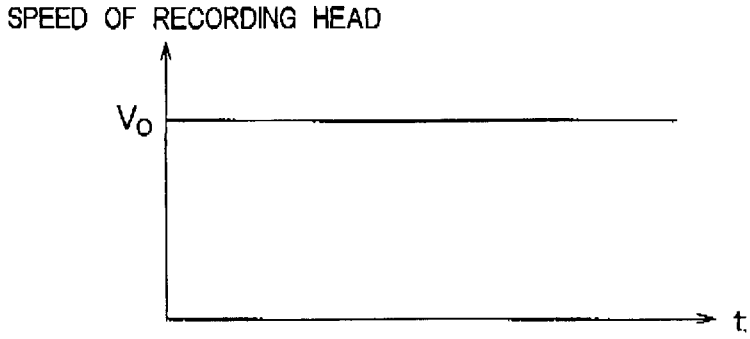
FIGS. 21A and 21B are graphs for explaining a constant-speed moving state of a recording head.
Figure 21B:
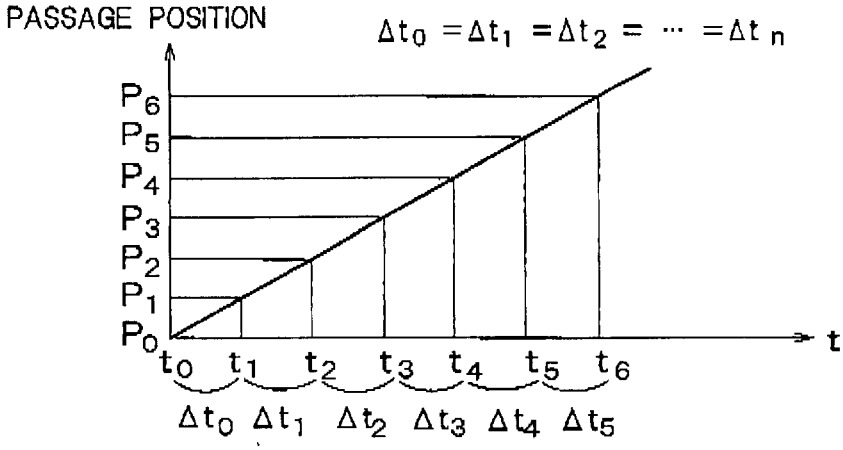
Figure 21C:
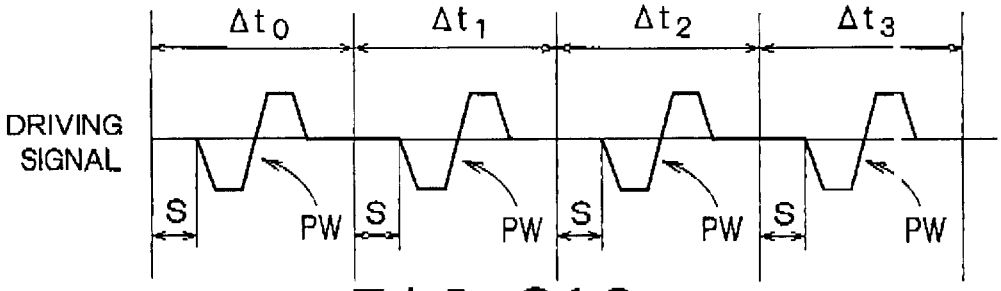
FIG. 21C is a diagram of an example of a forward driving signal.
Figure 21D:
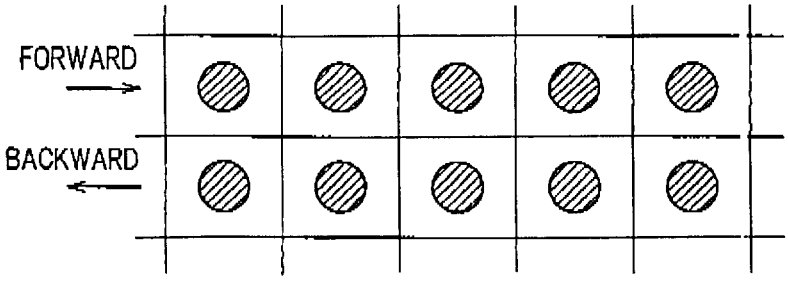
FIG. 21D is a view showing respective positions which a plurality of drops of ink reach during a constant-speed forward movement and respective positions which a plurality of drops of ink reach during a constant-speed backward movement, according to a conventional way.
Figure 22A:
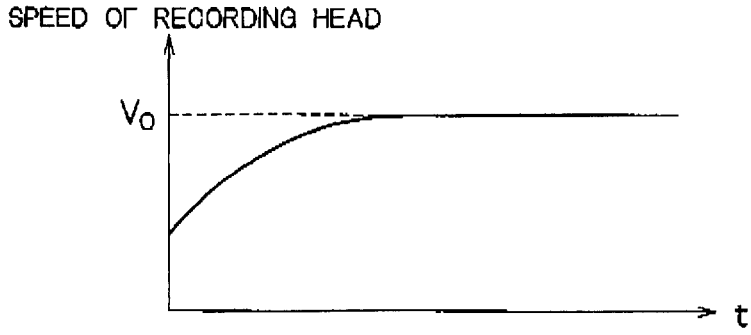
FIGS. 22A and 22B are graphs for explaining an accelerating (speed-increasing) moving state of a recording head.
Figure 22B:
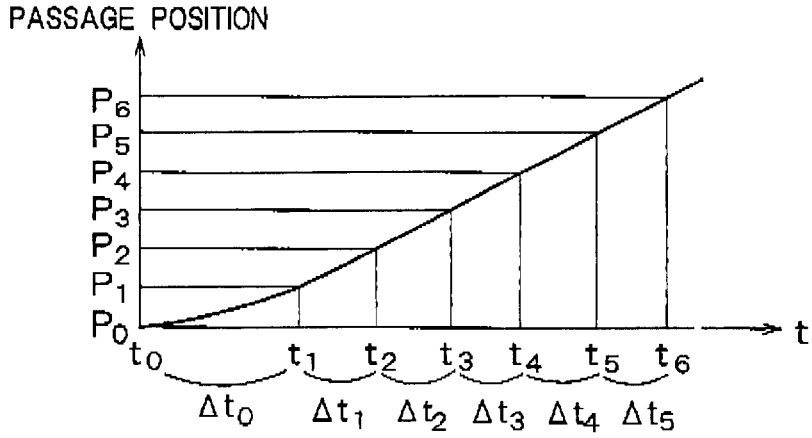
Figure 22C:
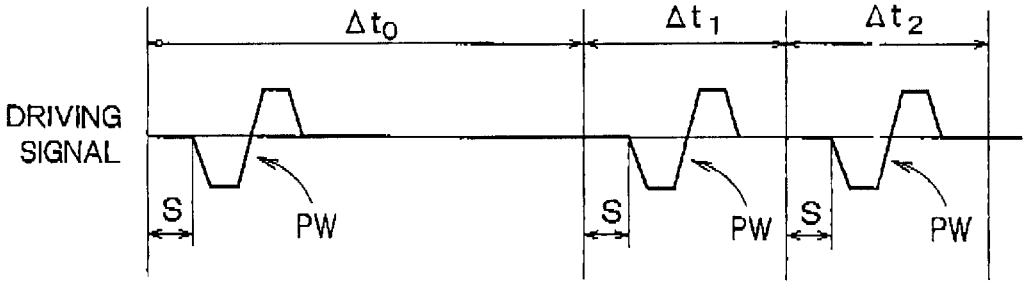
FIG. 22C is a diagram of an example of a forward driving signal.
Figure 22D:
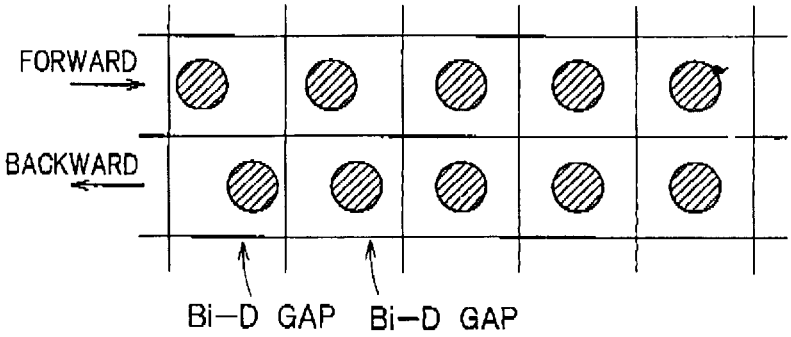
FIG. 22D is a view showing respective positions which a plurality of drops of ink reach during an accelerating forward movement and respective positions which a plurality of drops of ink reach during an accelerating backward movement, according to a conventional way.

Then, a preferable example of a backward jetting-driving signal for the case is shown in FIG. 20. The jetting-driving signal F shown in FIG. 20 corresponds to the backward-moving state of the recording head 10 shown in FIGS. 7A and 7B, and includes: a plurality of backward first pulse-waves PW21" that respectively fall down when respective first backward pulse-waiting-times $RS1_n$ have passed since respective backward-timings $RT_n$; a plurality of backward second pulse-waves PW22" that respectively fall down when respective second backward pulse-waiting-times $RS2_n$ have passed since the respective backward-timings $RT_n$; and a plurality of backward third pulse-waves PW23" that respectively fall down when respective third backward pulse-waiting-times $RS3_n$ have passed since the respective backward-timings $RT_n$.

The first backward pulse-waiting-times $RS1_n$ are respectively defined correspondingly to the respective backward-timings $RT_n$. The second backward pulse-waiting-times $RS2_n$ are also respectively defined correspondingly to the respective backward-timings $RT_n$, and the third backward pulse-waiting-times $RS3_n$ are also respectively defined correspondingly to the respective backward-timings $RT_n$.

The details of determination of the first backward pulse-waiting-times $RS1_n$, the second backward pulse-waiting-times $RS2_n$ and the third backward pulse-waiting-times $RS3_n$ are substantially the same as those of determination of the first backward pulse-waiting-times $RS1_n$ and the second backward pulse-waiting-times $RS2_n$ for the driving signal B2.

In the driving signal F, each of the backward first pulse-waves PW21" is the large-dot driving pulse DP13' for jetting a large drop of the ink from the nozzle 13, each of the backward second pulse-waves PW22" is the small-dot driving pulse DP12' for jetting a small drop of the ink from the nozzle 13, and each of the backward third pulse-waves PW23" is the middle-dot driving pulse DP11' for jetting a middle drop of the ink from the nozzle 13.

As shown in FIGS. 19 and 20, even if the forward jetting-driving signal and the backward jetting-driving signal have a plurality of three or more pulse-waves whose waveforms are different, substantially the same effect as the above embodiment can be achieved.

The driving-signal generating circuit 30 may be formed by a DAC circuit or an analogue circuit.

Current

A pressure-changing unit for causing the volume of the pressure chamber 16 to change is not limited to the piezoelectric vibrating member 15. For example, a pressure-changing unit can consist of a magnetic distortion (magnetostrictive) device. In the case, the magnetic distortion device causes the pressure chamber 16 to expand and contract, thus, causes the pressure of the ink in the pressure chamber 16 to change. Alternatively, a pressure-changing unit can consist of a heating device. In the case, the heating device causes an air bubble in the pressure chamber 16 to expand and contract, thus, causes the pressure of the ink in the pressure chamber 16 to change.

In addition, as described above, the printer controller 23 can be materialized by a computer System. A program for materializing the above one or more components in a computer system, and a storage unit 201 storing the program and capable of being read by a computer, are intended to be protected by this application.

In addition, when the above one or more components may be materialized in a computer system by using a general program (second program) such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the ink-jetting printer as a liquid jetting apparatus of the embodiment according to the invention. However, this invention is intended to apply to general liquid jetting apparatuses widely. A liquid may be glue, nail polish or the like, instead of the ink.

What is claimed is:

1. A liquid jetting apparatus comprising a head member having a nozzle, a pressure-changing unit that can cause pressure of liquid in the nozzle to change in such a manner that the liquid is jetted from the nozzle, a reciprocating mechanism that can move the head member forward and backward at a variable speed in such a manner that the head member passes through a plurality of predetermined passage-positions, a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

2. A liquid jetting apparatus according to claim 1, wherein:

the plurality of forward pulse-waiting-times are respectively defined correspondingly to the respective forward-timings, dependently on a forward-moving state of the head member by means of the reciprocating mechanism, and the plurality of backward pulse-waiting-times are respectively defined correspondingly to the respective backward-timings, dependently on a backward-moving state of the head member by means of the reciprocating mechanism.

3. A liquid jetting apparatus according to claim 2, wherein:

the plurality of forward pulse-waiting-times are respectively defined correspondingly to the respective forward-timings, based on a predetermined acceleration-deceleration curve for the head member to be moved forward, and the plurality of backward pulse-waiting-times are respectively defined correspondingly to the respective backward-timings, based on a predetermined acceleration-deceleration curve for the head member to be moved backward.

4. A liquid jetting apparatus according to claim 2, wherein:

the plurality of forward pulse-waiting-times are respectively defined correspondingly to the respective forward-timings, based on respective speeds of the head member obtained at the respective forward-timings, and the plurality of backward pulse-waiting-times are respectively defined correspondingly to the respective backward-timings, based on respective speeds of the head member obtained at the respective backward-timings.

5. A liquid jetting apparatus according to claim 2, wherein:

the plurality of forward pulse-waiting-times are respectively defined correspondingly to the respective forward-timings, based on changes of respective time-gaps between adjacent two forward-timings, and the plurality of backward pulse-waiting-times are respectively defined correspondingly to the respective backward-timings, based on changes of respective time-gaps between adjacent two backward-timings.

6. A liquid jetting apparatus according to claim 2, wherein:

the plurality of forward pulse-waiting-times are respectively defined correspondingly to the respective forward-timings, based on information of environment in which the liquid jetting apparatus is installed, and the plurality of backward pulse-waiting-times are respectively defined correspondingly to the respective backward-timings, based on the information of environment.

7. A liquid jetting apparatus according to claim 2, wherein:

the plurality of forward pulse-waiting-times are respectively defined correspondingly to the respective forward-timings, based on information of an amount of liquid remaining in the head member, and the plurality of backward pulse-waiting-times are respectively defined correspondingly to the respective backward-timings, based on the information of an amount of liquid.

8. A liquid jetting apparatus according to claim 1, wherein:

the plurality of forward pulse-waiting-times are respectively defined correspondingly to the respective forward-timings in such a manner that a plurality of drops of liquid van be jetted at respective intermediate timings between adjacent two forward-timings, and the plurality of backward pulse-waiting-times are respectively defined correspondingly to the respective backward-timings in such a manner that a plurality of drops of liquid can be jetted at respective intermediate timings between adjacent two backward-timings.

9. A liquid jetting apparatus according to claim 1, wherein:

the plurality of forward pulse-waiting-times are respectively defined correspondingly to the respective forward-timings in such a manner that a plurality of drops of liquid can be jetted at respective intermediate positions between adjacent two passage-positions of the head member, the respective passage-positions corresponding to the respective forward-timings, and the plurality of backward pulse-waiting-times are respectively defined correspondingly to the respective backward-timings in such a manner that a plurality of drops of liquid can be jetted at respective intermediate positions between adjacent two passage-positions of the head member, the respective passage-positions corresponding to the respective backward-timings.

10. A liquid jetting apparatus according to claim 1, further comprising:

a supporting member that can support a medium, onto which liquid is to be jetted, in such a manner that the medium can face the nozzle of the head member moved forward and backward and that the medium is spaced away from the nozzle by substantially the same gap, wherein:

a position on the medium which a drop of liquid jetted by means of a forward pulse-wave reaches substantially coincides with a position on the medium which a drop of liquid jetted by means of a backward pulse-wave reaches, with respect to a direction in which the head member is moved forward and backward.

11. A liquid jetting apparatus comprising a head member having a nozzle, a pressure-changing unit that can cause pressure of liquid in the nozzle to change in such a manner that the liquid is jetted from the nozzle, a reciprocating mechanism that can move the head member forward and backward at a variable speed in such a manner that the head member passes through a plurality of predetermined passage-positions, a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of first forward pulse-waiting-times are respectively defined correspondingly to the respective forward-timings, a plurality of second forward pulse-waiting-times are also respectively defined correspondingly to the respective forward-timings, a plurality of first backward pulse-waiting-times are respectively defined correspondingly to the respective backward-timings, a plurality of second backward pulse-waiting-times are also respectively defined correspondingly to the respective backward-timings, the forward jetting-driving signal includes a plurality of forward first pulse-waves that respectively rise up or fall down when the respective first forward pulse-waiting-times have passed since the respective forward-timings, and a plurality of forward second pulse-waves that respectively rise up or fall down when the respective second forward pulse-waiting-times have passed since the respective forward-timings, the backward jetting-driving signal includes a plurality of backward first pulse-waves that respectively rise up or fall down when the respective first backward pulse-waiting-times have passed since the respective backward-timings, and a plurality of backward second pulse-waves that respectively rise up or fall down when the respective second backward pulse-waiting-times have passed since the respective backward-timings, each forward first pulse-wave and each backward second pulse-wave have the same waveform, and each forward second pulse-wave and each backward first pulse-wave have the same waveform.

12. A liquid jetting apparatus according to claim 11, wherein:

the plurality of first forward pulse-waiting-times are respectively defined correspondingly to the respective forward-timings, dependently on a forward-moving state of the head member by means of the reciprocating mechanism, the plurality of second forward pulse-waiting-times are also respectively defined correspondingly to the respective forward-timings, dependently on the forward-moving state of the head member by means of the reciprocating mechanism, the plurality of first backward pulse-waiting-times are respectively defined correspondingly to the respective backward-timings, dependently on a backward-moving state of the head member by means of the reciprocating mechanism, and the plurality of second backward pulse-waiting-times are also respectively defined correspondingly to the respective backward-timings, dependently on the backward-moving state of the head member by means of the reciprocating mechanism.

13. A liquid jetting apparatus according to claim 12, wherein:

the plurality of first forward pulse-waiting-times are respectively defined correspondingly to the respective forward-timings, based on a predetermined acceleration-deceleration curve for the head member to be moved forward, the plurality of second forward pulse-waiting-times are also respectively defined correspondingly to the respective forward-timings, based on the predetermined acceleration-deceleration curve for the head member to be moved forward, the plurality of first backward pulse-waiting-times are respectively defined correspondingly to the respective backward-timings, based on a predetermined acceleration-deceleration curve for the head member to be moved backward, and the plurality of second backward pulse-waiting-times are also respectively defined correspondingly to the respective backward-timings, based on the predetermined acceleration-deceleration curve for the head member to be moved backward.

14. A liquid jetting apparatus according to claim 12, wherein:

the plurality of first forward pulse-waiting-times are respectively defined correspondingly to the respective forward-timings, based on respective speeds of the head member obtained at the respective forward-timings, the plurality of second forward pulse-waiting-times are also respectively defined correspondingly to the respective forward-timings, based on the respective speeds of the head member obtained at the respective forward-timings, the plurality of first backward pulse-waiting-times are respectively defined correspondingly to the respective backward-timings, based on respective speeds of the head member obtained at the respective backward-timings, and the plurality of second backward pulse-waiting-times are also respectively defined correspondingly to the respective backward-timings, based on the respective speeds of the head member obtained at the respective backward-timings.

15. A liquid jetting apparatus according to claim 12, wherein:

the plurality of first forward pulse-waiting-times are respectively defined correspondingly to the respective forward-timings, based on changes of respective time-gaps between adjacent two forward-timings, the plurality of second forward pulse-waiting-times are also respectively defined correspondingly to the respective forward-timings, based on the changes of respective time-gaps between adjacent two forward-timings, the plurality of first backward pulse-waiting-times are respectively defined correspondingly to the respective backward-timings, based on changes of respective time-gaps between adjacent two backward-timings, and the plurality of second backward pulse-waiting-times are also respectively defined correspondingly to the respective backward-timings, based on the changes of respective time-gaps between adjacent two backward-timings.

16. A liquid jetting apparatus according to claim 12, wherein:

the plurality of first forward pulse-waiting-times are respectively defined correspondingly to the respective forward-timings, based on information of environment in which the liquid jetting apparatus is installed, the plurality of second forward pulse-waiting-times are also respectively defined correspondingly to the respective forward-timings, based on the information of environment, the plurality of first backward pulse-waiting-times are respectively defined correspondingly to the respective backward-timings, based on the information of environment, and the plurality of second backward pulse-waiting-times are also respectively defined correspondingly to the respective backward-timings, based on the information of environment.

17. A liquid jetting apparatus according to claim 12, wherein:

the plurality of first forward pulse-waiting-times are respectively defined correspondingly to the respective forward-timings, based on information of an amount of liquid remaining in the head member, the plurality of second forward pulse-waiting-times are also respectively defined correspondingly to the respective forward-timings, based on the information of an amount of liquid, the plurality of first backward pulse-waiting-times are respectively defined correspondingly to the respective backward-timings, based on the information of an amount of liquid, and the plurality of second backward pulse-waiting-times are also respectively defined correspondingly to the respective backward-timings, based on the information of an amount of liquid.

18. A liquid jetting apparatus according to claim 11, wherein:

the plurality of first forward pulse-waiting-times and the plurality of second forward pulse-waiting-times are respectively defined correspondingly to the respective forward-timings in such a manner that each difference between each first forward pulse-waiting-times and each second forward pulse-waiting-times corresponding to each forward-timing is a halt of time-gap between the forward-timing and the next forward-timing, and the plurality of first backward pulse-waiting-times and the plurality of second backward pulse-waiting-times are respectively defined correspondingly to the respective backward-timings in such a manner that each difference between each first backward pulse-waiting-times and each second backward pulse-waiting-times corresponding to each backward-timing is a half of time-gap between the backward-timing and the nest backward-timing.

19. A liquid jetting apparatus according to claim 11, wherein:

the plurality of first forward pulse-waiting-times and the plurality of second forward pulse-waiting-times are respectively defined correspondingly to the respective forward-timings in such a manner that a plurality of drops of liquid can be jetted at predetermined positions symmetric with respect to respective intermediate positions between adjacent two passage-positions of the head member, the respective passage-positions corresponding to the respective forward-timings, and the plurality of first backward pulse-waiting-times and the plurality of second backward pulse-waiting-times are respectively defined correspondingly to, the respective backward-timings in such a manner that a plurality of drops of liquid can be jetted at predetermined positions symmetric with respect to respective intermediate positions between adjacent two passage-positions of the head member, the respective passage-positions corresponding to the respective backward-timings.

20. A liquid jetting apparatus according to claim 11, further comprising:

a supporting member that can support a medium, onto which liquid is to be jetted, in such a manner that the medium can face the nozzle of the head member moved forward and backward and that the medium is spaced away from the nozzle by substantially the same gap, wherein:

a position on the medium which a drop of liquid jetted by means of a first forward pulse-wave reaches substantially coincides with a position on the medium which a drop of liquid jetted by means of a second backward pulse-wave reaches, with respect to a direction in which the head member is moved forward and backward, and a position on the medium which a drop of liquid jetted by means of a second forward pulse-wave reaches substantially coincides with a position on the medium which a drop of liquid jetted by means of a first backward pulse-wave reaches, with respect to the direction in which the head member is moved forward and backward.

21. A liquid jetting apparatus comprising a head member having a nozzle, a pressure-changing unit that can cause pressure of liquid in the nozzle to change in such a manner that the liquid is jetted from the nozzle, a reciprocating mechanism that can move the head member forward and backward at a variable speed in such a manner that the head member passes through a plurality of predetermined passage-positions, a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of first forward pulse-waiting-times are respectively defined correspondingly to the respective forward-timings, a plurality of second forward pulse-waiting-times are also respectively defined correspondingly to the respective forward-timings, a plurality of third forward pulse-waiting-times are also respectively defined correspondingly to the respective forward-timings, a plurality of first backward pulse-waiting-times are respectively defined correspondingly to the respective backward-timings, a plurality of second backward pulse-waiting-times are also respectively defined correspondingly to the respective backward-timings, a plurality of third backward pulse-waiting-times are also respectively defined correspondingly to the respective backward-timings, the forward jetting-driving signal includes a plurality of forward first pulse-waves that respectively rise up or fall down when the respective first forward pulse-waiting-times have passed since the respective forward-timings, a plurality of forward second pulse-waves that respectively rise up or fall down when the respective second forward pulse-waiting-times have passed since the respective forward-timings, and a plurality of forward third pulse-waves that respectively rise up or fall down when the respective third forward pulse-waiting-times have passed since the respective forward-timings, the backward jetting-driving signal includes a plurality of backward first pulse-waves that respectively rise up or fall down when the respective first backward pulse-waiting-times have passed since the respective backward-timings, a plurality of backward second pulse-waves that respectively rise up or fall down when the respective second backward pulse-waiting-times have passed since the respective backward-timings, and a plurality of backward third pulse-waves that respectively rise up or fall down when the respective third backward pulse-waiting-times have passed since the respective backward-timings, each forward first pulse-wave and each backward third pulse-wave have the same waveform, each forward second pulse-wave and each backward second pulse-wave have the same waveform, and each forward third pulse-wave and each backward first pulse-wave have the same waveform.

22. A liquid jetting apparatus according to claim 21, wherein:

the plurality of first forward pulse-waiting-times are respectively defined correspondingly to the respective forward-timings, dependently on a forward-moving state of the head member by means of the reciprocating mechanism, the plurality of second forward pulse-waiting-times are also respectively defined correspondingly to the respective forward-timings, dependently on the forward-moving state of the head member by means of the reciprocating mechanism, the plurality of third forward pulse-waiting-times are also respectively defined correspondingly to the respective forward-timings, dependently on the forward-moving state of the head member by means of the reciprocating mechanism, the plurality of first backward pulse-waiting-times are respectively defined correspondingly to the respective backward-timings, dependently on a backward-moving state of the head member by means of the reciprocating mechanism, the plurality of second backward pulse-waiting-times are also respectively defined correspondingly to the respective backward-timings, dependently on the backward-moving state of the head member by means of the reciprocating mechanism, and the plurality of third backward pulse-waiting-times are also respectively defined correspondingly to the respective backward-timings, dependently on the backward-moving state of the head member by means of the reciprocating mechanism.

23. A controlling unit for controlling a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

24. A controlling unit according to claim 23, wherein:

the plurality of forward pulse-waiting-times are respectively defined correspondingly to the respective forward-timings, dependently on a forward-moving state of the head member by means of the reciprocating mechanism, and the plurality of backward pulse-waiting-times are respectively defined correspondingly to the respective backward-timings, dependently on a backward-moving state of the head member by means of the reciprocating mechanism.

25. A controlling unit according to claim 24, wherein:

the plurality of forward pulse-waiting-times are respectively defined correspondingly to the respective forward-timings, based on a predetermined acceleration-deceleration curve for the head member to be moved forward, and the plurality of backward pulse-waiting-times are respectively defined correspondingly to the respective backward-timings, based on a predetermined acceleration-deceleration curve for the head member to be moved backward.

26. A controlling unit according to claim 24, wherein:

the plurality of forward pulse-waiting-times are respectively defined correspondingly to the respective forward-timings, based on respective speeds of the head member obtained at the respective forward-timings, and the plurality of backward pulse-waiting-times are respectively defined correspondingly to the respective backward-timings, based on respective speeds of the head member obtained at the respective backward-timings.

27. A controlling unit according to claim 24, wherein:

the plurality of forward pulse-waiting-times are respectively defined correspondingly to the respective forward-timings, based on changes of respective time-gaps between adjacent two forward-timings, and the plurality of backward pulse-waiting-times are respectively defined correspondingly to the respective backward-timings, based on changes of respective time-gaps between adjacent two backward-timings.

28. A controlling unit according to claim 24, wherein:

the plurality of forward pulse-waiting-times are respectively defined correspondingly to the respective forward-timings, based on information of environment in which the liquid jetting apparatus is installed, and the plurality of backward pulse-waiting-times are respectively defined correspondingly to the respective backward-timings, based on the information of environment.

29. A controlling unit according to claim 24, wherein:

the plurality of forward pulse-waiting-times are respectively defined correspondingly to the respective forward-timings, based on information of an amount of liquid remaining in the head member, and the plurality of backward pulse-waiting-times are respectively defined correspondingly to the respective backward-timings, based on the information of an amount of liquid.

30. A controlling unit according to claim 23, wherein:

the plurality of forward pulse-waiting-times are respectively defined correspondingly to the respective forward-timings in such a manner that a plurality of drops of liquid can be jetted at respective intermediate timings between adjacent two forward-timings, and the plurality of backward pulse-waiting-times are respectively defined correspondingly to the respective backward-timings in such a manner that a plurality of drops of liquid can be jetted at respective intermediate timings between adjacent two backward-timings.

31. A controlling unit according to claim 23, wherein:

the plurality of forward pulse-waiting-times are respectively defined correspondingly to the respective forward-timings in such a manner that a plurality of drops of liquid can be jetted at respective intermediate positions between adjacent two passage-positions of the head member, the respective passage-positions corresponding to the respective forward-timings, and the plurality of backward pulse-waiting-times are respectively defined correspondingly to the respective backward-timings in such a manner that a plurality of drops of liquid can be jetted at respective intermediate positions between adjacent two passage-positions of the head member, the respective passage-positions corresponding to the respective backward-timings.

32. A controlling unit according to claim 23, wherein:

a position on a medium which a drop of liquid jetted by means of a forward pulse-wave reaches substantially coincides with a position on the medium which a drop of liquid jetted by means of a backward pulse-wave reaches, with respect to a direction in which the head member is moved forward and backward.

33. A controlling unit for controlling a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising:

a forward-driving-signal generator that can generate a forward jetting-driving signal, based on a plurality of forward-timings respectively defined correspondingly to the plurality of predetermined passage-positions while the head member is moved forward, a forward driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of first forward pulse-waiting-times are respectively defined correspondingly to the respective forward-timings, a plurality of second toward pulse-waiting-times are also respectively defined correspondingly to the respective forward-timings, a plurality of first backward pulse-waiting-times are respectively defined correspondingly to the respective backward-timings, a plurality of second backward pulse-waiting-times are also respectively defined correspondingly to the respective backward-timings, the forward jetting-driving signal includes a plurality of forward first pulse-waves that respectively rise up or fall down when the respective first forward pulse-waiting-times have passed since the respective forward-timings, and a plurality of forward second pulse-waves that respectively rise up or fall down when the respective second forward pulse-waiting-times have passed since the respective forward-timings, the backward jetting-driving signal includes a plurality of backward first pulse-waves that respectively rise up or fall down when the respective first backward pulse-waiting-times have passed since the respective backward-timings, and a plurality of backward second pulse-waves that respectively rise up or fall down when the respective second backward pulse-waiting-times have passed since the respective backward-timings, each forward first pulse-wave and each backward second pulse-wave have the same waveform, and each forward second pulse-wave and each backward first pulse-wave have the same waveform.

34. A controlling unit according to claim 33, wherein:

the plurality of first forward pulse-waiting-times are respectively defined correspondingly to the respective forward-timings, dependently on a forward-moving state of the head member by means of the reciprocating mechanism, the plurality of second forward pulse-waiting-times are also respectively defined correspondingly to the respective forward-timings, dependently on the forward-moving state of the head member by means of the reciprocating mechanism, the plurality of first backward pulse-waiting-times are respectively defined correspondingly to the respective backward-timings, dependently on a backward-moving state of the head member by means of the reciprocating mechanism, and the plurality of second backward pulse-waiting-times are also respectively defined correspondingly to the respective backward-timings, dependently on the backward-moving state of the head member by means of the reciprocating mechanism.

35. A controlling unit according to claim 34, wherein:

the plurality of first forward pulse-waiting-times are respectively defined correspondingly to the respective forward-timings, based on a predetermined acceleration-deceleration curve for the head member to be moved forward, the plurality of second forward pulse-waiting-times are also respectively defined correspondingly to the respective forward-timings, based on the predetermined acceleration-deceleration curve for the head member to be moved forward, the plurality of first backward pulse-waiting-times are respectively defined correspondingly to the respective backward-timings, based on a predetermined acceleration-deceleration curve for the head member to be moved backward, and the plurality of second backward pulse-waiting-times are also respectively defined correspondingly to the respective backward-timings, based on the predetermined acceleration-deceleration curve for the head member to be moved backward.

36. A controlling unit according to claim 34, wherein:

the plurality of first forward pulse-waiting-times are respectively defined correspondingly to the respective forward-timings, based on respective speeds of the head member obtained at the respective forward-timings, the plurality of second forward pulse-waiting-times are also respectively defined correspondingly to the respective forward-timings, based on the respective speeds of the head member obtained at the respective forward-timings, the plurality of first backward pulse-waiting-times are respectively defined correspondingly to the respective backward-timings, based on respective speeds of the head member obtained at the respective backward-timings, and the plurality of second backward pulse-waiting-times are also respectively defined correspondingly to the respective backward-timings, based on the respective speeds of the head member obtained at the respective backward-timings.

37. A controlling unit according to claim 34, wherein:

the plurality of first forward pulse-waiting-times are respectively defined correspondingly to the respective forward-timings, based on changes of respective time-gaps between adjacent two forward-timings, the plurality of second forward pulse-waiting-times are also respectively defined correspondingly to the respective forward-timings, based on the changes of respective time-gaps between adjacent two forward-timings, the plurality of first backward pulse-waiting-times are respectively defined correspondingly to the respective backward-timings, based on changes of respective time-gaps between adjacent two backward-timings, and the plurality of second backward pulse-waiting-times are also respectively defined correspondingly to the respective backward-timings, based on the changes of respective time-gaps between adjacent two backward-timings.

38. A controlling unit according to claim 34, wherein:

the plurality of first forward pulse-waiting-times are respectively defined correspondingly to the respective forward-timings, based on information of environment in which the liquid jetting apparatus is installed, the plurality of second forward pulse-waiting-times are also respectively defined correspondingly to the respective forward-timings, based on the information of environment, the plurality of first backward pulse-waiting-times are respectively defined correspondingly to the respective backward-timings, based on the information of environment, and the plurality of second backward pulse-waiting-times are also respectively defined correspondingly to the respective backward-timings, based on the information of environment.

39. A controlling unit according to claim 34, wherein:

the plurality of first forward pulse-waiting-times are respectively defined correspondingly to the respective forward-timings, based on information of an amount of liquid remaining in the head member, the plurality of second forward pulse-waiting-times are also respectively defined correspondingly to the respective forward-timings, based on the information of an amount of liquid, the plurality of first backward pulse-waiting-times are respectively defined correspondingly to the respective backward-timings, based on the information of an amount of liquid, and the plurality of second backward pulse-waiting-times are also respectively defined correspondingly to the respective backward-timings, based on the information of an amount of liquid.

40. A controlling unit according to claim 33, wherein:

the plurality of first forward pulse-waiting-times and the plurality of second forward pulse-waiting-times are respectively defined correspondingly to the respective forward-timings in such a manner that each difference between each first forward pulse-waiting-times and each second forward pulse-waiting-times corresponding to each forward-timing is a half of time-gap between the forward-timing and the next forward-timing, and the plurality of first backward pulse-waiting-times and the plurality of second backward pulse-waiting-times are respectively defined correspondingly to the respective backward-timings in such a manner that each difference between each first backward pulse-waiting-times and each second backward pulse-waiting-times corresponding to each backward-timing is a half of time-gap between the backward-timing and the nest backward-timing.

41. A controlling unit according to claim 33, wherein:

the plurality of first forward pulse-waiting-times and the plurality of second forward pulse-waiting-ties are respectively defined correspondingly to the respective forward-timings in such a manner that a plurality of drops of liquid can be jetted at predetermined positions symmetric with respect to respective intermediate positions between adjacent two passage-positions of the head member, the respective passage-positions corresponding to the respective forward-timings, and the plurality of first backward pulse-waiting-times and the plurality of second backward pulse-waiting-times are respectively defined correspondingly to the respective backward-timings in such a manner that a plurality of drops of liquid can be jetted at predetermined positions symmetric with respect to respective intermediate positions between adjacent two passage-positions of the head member, the respective passage-positions corresponding to the respective backward-timings.

42. A controlling unit according to claim 33, wherein:

a position on a medium which a drop of liquid jetted by means of a first forward pulse-wave reaches substantially coincides with a position on the medium which a drop of liquid jetted by means of a second backward pulse-wave reaches, with respect to a direction in which the head member is moved forward and backward, and a position on the medium which a drop of liquid jetted by means of a second forward pulse-wave reaches substantially coincides with a position on the medium which a drop of liquid jetted by means of a first backward pulse-wave reaches, with respect to the direction in which the head member is moved forward and backward.

43. A controlling unit for controlling a liquid jetting apparatus including: a head member having a nozzle; a pressure-changing unit that can cause pressure of liquid in the nozzle to change in such a manner that the liquid is jetted from the nozzle; and a reciprocating mechanism that can move the head member forward and backward at a variable speed in such a manner that the head member passes through a plurality of predetermined passage-positions; the controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of first forward pulse-waiting-times are respectively defined correspondingly to the respective forward-timings, a plurality of second forward pulse-waiting-times are also respectively defined correspondingly to the respective forward-timings, a plurality of third forward pulse-waiting-times are also respectively defined correspondingly to the respective forward-timings, a plurality of first backward pulse-waiting-times are respectively defined correspondingly to the respective backward-timings, a plurality of second backward pulse-waiting-times are also respectively defined correspondingly to the respective backward-timings, a plurality of third backward pulse-waiting-times are also respectively defined correspondingly to the respective backward-timings, the forward jetting-driving signal includes a plurality of forward first pulse-waves that respectively rise up or fall down when the respective first forward pulse-waiting-times have passed since the respective forward-timings, a plurality of forward second pulse-waves that respectively rise up or fall down when the respective second forward pulse-waiting-times have passed since the respective forward-timings, and a plurality of forward third pulse-waves that respectively rise up or fall down when the respective third forward pulse-waiting-times have passed since the respective forward-timings, the backward jetting-driving signal includes a plurality of backward first pulse-waves that respectively rise up or fall down when the respective first backward pulse-waiting-times have passed since the respective backward-timings, a plurality of backward second pulse-waves that respectively rise up or fall down when the respective second backward pulse-waiting-times have passed since the respective backward-timings, and a plurality of backward third pulse-waves that respectively rise up or fall down when the respective third backward pulse-baiting-times have passed since the respective backward-timings, each forward first pulse-wave and each backward third pulse-wave have the same waveform, each forward second pulse-wave and each backward second pulse-wave have the same waveform, and each forward third pulse-wave and each backward first pulse-wave have the same waveform.

44. A controlling unit according to claim 43, wherein:

the plurality of first forward pulse-waiting-times are respectively defined correspondingly to the respective forward-timings, dependently on a forward-moving state of the head member by means of the reciprocating mechanism, the plurality of second forward pulse-waiting-times are also respectively defined correspondingly to the respective forward-timings, dependently on the forward-moving state of the head member by means of the reciprocating mechanism, the plurality of third forward pulse-waiting-times are also respectively defined correspondingly to the respective forward-timings, dependently on the forward-moving state of the head member by means of the reciprocating mechanism, the plurality of first backward pulse-waiting-times are respectively defined correspondingly to the respective backward-timings, dependently on a backward-moving state of the head member by means of the reciprocating mechanism, the plurality of second backward pulse-waiting-times are also respectively defined correspondingly to the respective backward-timings, dependently on the backward-moving state of the head member by means of the reciprocating mechanism, and the plurality of third backward pulse-waiting-times are also respectively defined correspondingly to the respective backward-timings, dependently on the backward-moving state of the head member by means of the reciprocating mechanism.

45. A storage unit capable of being read by a computer, storing a program for materializing a controlling unit that can control a liquid jetting apparatus including: a head member having a nozzle, a pressure-changing unit that can cause pressure of liquid in the nozzle to change in such a manner that the liquid is jetted from the nozzle, and a reciprocating mechanism that can move the head member forward and backward at a variable speed in such a manner that the head member passes through a plurality of predetermined passage-positions;

said controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

46. A storage unit capable of being read by a computer, storing a program including a command for controlling a second program executed by a computer system including a computer, said program being executed by the computer system to control the second program to materialize a controlling unit that can control a liquid jetting apparatus including: a head member having a nozzle, a pressure-changing unit that can cause pressure of liquid in the nozzle to change in such a manner that the liquid is jetted from the nozzle, and a reciprocating mechanism that can move the head member forward and backward at a variable speed in such a manner that the head member passes through a plurality of predetermined passage-positions;

said controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

47. A program for materializing a controlling unit that can control a liquid jetting apparatus including: a head member having a nozzle, a pressure-changing unit that can cause pressure of liquid in the nozzle to change in such a manner that the liquid is jetted from the nozzle, and a reciprocating mechanism that can move the head member forward and backward at a variable speed in such a manner that the head member passes through a plurality of predetermined passage-positions;

said controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to, the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-tins have passed since the respective backward-timings, and each forward pulse-wave and each backward pulse-wave have the same waveform.

48. A program including a command for controlling a second program executed by a computer system including a computer, said program being executed by the computer system to control the second program to materialize a controlling unit that can control a liquid jetting apparatus including: a head member having a nozzle, a pressure-changing unit that can cause pressure of liquid in the nozzle to change in such a manner that the liquid is jetted from the nozzle, and a reciprocating mechanism that can move the head member forward and backward at a variable speed in such a manner that the head member passes through a plurality of predetermined passage-positions;

said controlling unit comprising:

a forward-driving-signal generator that can generate a forward jetting-driving signal, based on a plurality of forward-timings respectively defined correspondingly to the plurality of predetermined passage-positions while the head member is moved forward, a forward-driving-pulse generator that can generate a forward driving pulse based on the forward jetting-driving signal, a backward-driving-signal generator that can generate a backward jetting-driving signal, based on a plurality of backward-timings respectively defined correspondingly to the plurality of predetermined passage-positions while the head member is moved backward, a backward-driving-pulse generator that can generate a backward driving pulse based on the backward jetting-driving signal, and a main controller that can cause the pressure-changing unit to operate based on the forward driving pulse while the head member is moved forward, and that can cause the pressure-changing unit to operate based on the backward driving pulse while the head member is moved backward, wherein a plurality of forward pulse-waiting-times are respectively defined correspondingly to the respective forward-timings, a plurality of backward pulse-waiting-times are respectively defined correspondingly to the respective backward-timings, the forward jetting-driving signal includes a plurality of forward pulse-waves that respectively rise up or fall down when the respective forward pulse-waiting-times have passed since the respective forward-timings, the backward jetting-driving signal includes a plurality of backward pulse-waves that respectively rise up or fall down when the respective backward pulse-waiting-times have passed since the respective backward-timings, and each forward pulse-wave and each backward pulse-wave have the same waveform.

* * * * *